US008173341B2

(12) United States Patent
Yu et al.

(10) Patent No.: US 8,173,341 B2
(45) **Date of Patent: *May 8, 2012**

(54) FLEXIBLE IMAGING MEMBERS WITHOUT ANTICURL LAYER

(75) Inventors: Robert C. U. Yu, Webster, NY (US); Stephen T. Avery, Rochester, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 464 days.

This patent is subject to a terminal disclaimer.

(21) Appl. No.: 12/434,535

(22) Filed: May 1, 2009

(65) Prior Publication Data

US 2010/0279218 A1 Nov. 4, 2010

(51) Int. Cl.
*G03G 5/00* (2006.01)

(52) U.S. Cl. ..... 430/58.5; 430/58.05

(58) Field of Classification Search ..... 430/58.8, 430/58.05

See application file for complete search history.

(56) References Cited

U.S. PATENT DOCUMENTS

| | | | |
|---|---|---|---|
| 3,121,006 | A | 2/1964 | Middleton et al. |
| 3,820,989 | A | 6/1974 | Rule et al. |
| 3,837,851 | A | 9/1974 | Shattuck et al. |
| 3,895,944 | A | 7/1975 | Wiedemann et al. |
| 4,033,714 | A | 7/1977 | Longworth |
| 4,150,987 | A | 4/1979 | Anderson et al. |
| 4,245,021 | A | 1/1981 | Kazami et al. |
| 4,256,821 | A | 3/1981 | Enomoto et al. |
| 4,265,990 | A | 5/1981 | Stolka et al. |
| 4,278,746 | A | 7/1981 | Goto et al. |
| 4,286,033 | A | 8/1981 | Neyhart et al. |
| 4,291,110 | A | 9/1981 | Lee |
| 4,297,426 | A | 10/1981 | Sakai et al. |
| 4,315,982 | A | 2/1982 | Ishikawa et al. |
| 4,338,387 | A | 7/1982 | Hewitt |
| 4,338,388 | A | 7/1982 | Sakai et al. |
| 4,385,106 | A | 5/1983 | Sakai |
| 4,387,147 | A | 6/1983 | Sakai |
| 4,399,207 | A | 8/1983 | Sakai et al. |
| 4,399,208 | A | 8/1983 | Takasu et al. |
| 4,587,189 | A | 5/1986 | Hor et al. |
| 4,664,995 | A | 5/1987 | Horgan et al. |
| 4,988,597 | A | 1/1991 | Spiewak et al. |
| 5,215,839 | A | 6/1993 | Yu |
| 5,244,762 | A | 9/1993 | Spiewak et al. |
| 5,660,961 | A | 8/1997 | Yu |
| 5,697,024 | A | 12/1997 | Mishra |
| 5,703,487 | A | 12/1997 | Mishra |
| 5,756,245 | A | 5/1998 | Esteghamatian et al. |
| 5,958,638 | A | 9/1999 | Katayama et al. |
| 6,008,653 | A | 12/1999 | Popovic et al. |
| 6,119,536 | A | 9/2000 | Popovic et al. |
| 6,124,514 | A | 9/2000 | Emmrich et al. |
| 6,150,824 | A | 11/2000 | Mishra et al. |
| 6,183,921 | B1 | 2/2001 | Yu et al. |
| 6,214,514 | B1 | 4/2001 | Evans et al. |
| 6,660,441 | B2 | 12/2003 | Yu |
| 6,756,169 | B2 | 6/2004 | Lin et al. |
| 6,933,089 | B2 | 8/2005 | Horgan et al. |
| 7,018,756 | B2 | 3/2006 | Pai et al. |
| 7,413,835 | B2 | 8/2008 | Lin et al. |
| 2006/0099525 | A1 | 5/2006 | Yu et al. |

*Primary Examiner* — Mark A Chapman

(74) *Attorney, Agent, or Firm* — Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to the incorporation of a liquid compound having a high boiling point into the charge transport layer such that an anticurl back coating is no longer needed for reduction or elimination of photoreceptor layer curling.

25 Claims, 5 Drawing Sheets

FLEXIBLE IMAGING MEMBERS WITHOUT ANTICURL LAYER

BACKGROUND

The presently disclosed embodiments are directed to an imaging member used in electrostatography. More particularly, the embodiments pertain to a structurally simplified flexible electrophotographic imaging member without the need of an anticurl back coating layer and a process for making and using the member.

In electrophotographic or electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Flexible electrostatographic imaging members are well known in the art. Typical flexible electrostatographic imaging members include, for example: (1) electrophotographic imaging member belts (belt photoreceptors) commonly utilized in electrophotographic (xerographic) processing systems; (2) electroreceptors such as ionographic imaging member belts for electrographic imaging systems; and (3) intermediate toner image transfer members such as an intermediate toner image transferring belt which is used to remove the toner images from a photoreceptor surface and then transfer the very images onto a receiving paper. The flexible electrostatographic imaging members may be seamless or seamed belts; and seamed belts are usually formed by cutting a rectangular sheet from a web, overlapping opposite ends, and welding the overlapped ends together to form a welded seam. Typical electrophotographic imaging member belts include a charge transport layer and a charge generating layer on one side of a supporting substrate layer and an anticurl back coating coated onto the opposite side of the substrate layer. A typical electrographic imaging member belt does, however, have a more simple material structure; it includes a dielectric imaging layer on one side of a supporting substrate and an anti-curl back coating on the opposite side of the substrate to render flatness. Although the scope of the present embodiments covers the preparation of all types of flexible electrostatographic imaging members, however for reason of simplicity, the discussion hereinafter will focus and be represented only on flexible electrophotographic imaging members.

Electrophotographic flexible imaging members may include a photoconductive layer including a single layer or composite layers. Since typical flexible electrophotographic imaging members exhibit undesirable upward imaging member curling, an anti-curl back coating, applied to the backside, is required to balance the curl. Thus, the application of anticurl back coating is necessary to provide the appropriate imaging member belt with desirable flatness.

One type of composite photoconductive layer used in xerography is illustrated in U.S. Pat. No. 4,265,990 which describes a photosensitive member having at least two electrically operative layers. One layer comprises a photoconductive layer which is capable of photogenerating holes and injecting the photogenerated holes into a contiguous charge transport layer. Generally, where the two electrically operative layers are supported on a conductive layer, the photoconductive layer is sandwiched between a contiguous charge transport layer and the supporting conductive layer. Alternatively, the charge transport layer may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a receiving member such as paper.

In the case where the charge generating layer is sandwiched between the outermost exposed charge transport layer and the electrically conducting layer, the outer surface of the charge transport layer is charged negatively and the conductive layer is charged positively. The charge generating layer then should be capable of generating electron hole pair when exposed image wise and inject only the holes through the charge transport layer. In the alternate case when the charge transport layer is sandwiched between the charge generating layer and the conductive layer, the outer surface of the charge generating layer is charged positively while conductive layer is charged negatively and the holes are injected through from the charge generating layer to the charge transport layer. The charge transport layer should be able to transport the holes with as little trapping of charge as possible. In flexible imaging member belt such as photoreceptor, the charge conductive layer may be a thin coating of metal on a flexible substrate support layer.

As more advanced, higher speed electrophotographic copiers, duplicators and printers were developed, however, degradation of image quality was encountered during extended cycling. The complex, highly sophisticated duplicating and printing systems operating at very high speeds have placed stringent requirements including narrow operating limits on photoreceptors. For example, the numerous layers used in many modern photoconductive imaging members should be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, an optional blocking layer, an optional adhesive layer, a charge generating layer, a charge transport layer and a conductive ground strip layer adjacent to one edge of the imaging layers, and may optionally include an overcoat layer over the imaging layer(s) to provide abrasion/wear protection. In such a photoreceptor, it does usually further comprise an anticurl back coating layer on the side of the substrate opposite the side carrying the conductive layer, support layer, blocking layer, adhesive layer, charge generating layer, charge transport layer, and other layers.

Typical negatively-charged imaging member belts, such as flexible photoreceptor belt designs, are made of multiple layers comprising a flexible supporting substrate, a conductive ground plane, a charge blocking layer, an optional adhesive layer, a charge generating layer, a charge transport layer. The charge transport layer is usually the last layer, or the outermost layer, to be coated and is applied by solution coating then followed by drying the wet applied coating at elevated temperatures of about 120° C., and finally cooling it down to ambient room temperature of about 25° C. When a production web stock of several thousand feet of coated multilayered photoreceptor material is obtained after finishing solution application of the charge transport layer coating and through drying/cooling process, upward curling of the multilayered photoreceptor is observed. This upward curling is a consequence of thermal contraction mismatch between the charge transport layer and the substrate support. Since the charge transport layer in a typical photoreceptor device has a coefficient of thermal contraction approximately 3.7 times greater than that of the flexible substrate support, the charge transport layer does therefore have a larger dimensional shrinkage than that of the substrate support as the imaging member web stock cools down to ambient room temperature. The exhibition of imaging member curling after completion of charge transport layer coating is due to the consequence of the heating/cooling processing step, according to the mechanism: (1) as the web stock carrying the wet applied charge transport layer is dried at elevated temperature, dimensional contraction does occur when the wet charge transport layer coating is losing its solvent during 120° C. elevated temperature drying, but at 120° C. the charge transport layer remains as a viscous flowing liquid after losing its solvent. Since its glass transition temperature (Tg) is at 85° C., the charge transport layer after losing of solvent will flow to re-adjust itself, release internal stress, and maintain its dimension stability; (2) as the charge transport layer now in the viscous liquid state is cooling down further and reaching its glass transition temperature (Tg) at 85° C., the CTL instantaneously solidifies and adheres to the charge generating layer because it has then transformed itself from being a viscous liquid into a solid layer at its Tg; and (3) eventual cooling down the solid charge transport layer of the imaging member web from 85° C. down to 25° C. room ambient will then cause the charge transport layer to contract more than the substrate support since it has about 3.7 times greater thermal coefficient of dimensional contraction than that of the substrate support. This differential in dimensional contraction results in tension strain built-up in the charge transport layer which therefore, at this instant, pulls the imaging member upward to exhibit curling. If unrestrained at this point, the imaging member web stock will spontaneously curl upwardly into a 1.5-inch tube. To offset the curling, an anticurl back coating is applied to the backside of the flexible substrate support, opposite to the side having the charge transport layer, and render the imaging member web stock with desired flatness.

Curling of a photoreceptor web is undesirable because it hinders fabrication of the web into cut sheets and subsequent welding into a belt. An anticurl back coating, having an equal counter curling effect but in the opposite direction to the applied imaging layer(s), is applied to the reverse side of substrate support of the active imaging member to balance the curl caused by the mismatch of the thermal contraction coefficient between the substrate and the charge transport layer, resulting in greater charge transport layer dimensional shrinkage than that of the substrate. Although the application of an anticurl back coating is effective to counter and remove the curl, nonetheless the resulting imaging member in flat configuration does tension the charge transport layer creating an internal build-in strain of about 0.27% in the layer. The magnitude of CTL internal build-in strain is very undesirable, because it is additive to the induced bending strain of an imaging member belt as the belt bends and flexes over each belt support roller during dynamic fatigue belt cyclic motion under a normal machine electrophotiographic imaging function condition in the field. The summation of the internal strain and the cumulative fatigue bending strain sustained in the charge transport layer has been found to exacerbate the early onset of charge transport layer cracking, preventing the belt to reach its targeted functional imaging life. Moreover, imaging member belt employing an anticurl backing coating has additional total belt thickness to thereby increase charge transport layer bending strain and speed up belt cycling fatigue charge transport layer cracking. The cracks formed in the charge transport layer as a result of dynamic belt fatiguing are found to manifest themselves into copy print-out defects, which thereby adversely affect the image quality on the receiving paper.

Various belt function deficiencies have also been observed in the common anticurl back coating formulations used in a typical conventional imaging member belt, such as the anticurl back coating does not always providing satisfying dynamic imaging member belt performance result under a normal machine functioning condition; for example, exhibition of anticurl back coating wear and its propensity to cause electrostatic charging-up are the frequently seen problems to prematurely cut short the service life of a belt and requires its frequent costly replacement in the field. Anticurl back coating wear under the normal imaging member belt machine operational conditions reduces the anticurl back coating thickness, causing the lost of its ability to fully counteract the curl as reflected in exhibition of gradual imaging member belt curling up in the field. Curling is undesirable during imaging belt function because different segments of the imaging surface of the photoconductive member are located at different distances from charging devices, causing non-uniform charging. In addition, developer applicators and the like, during the electrophotographic imaging process, may all adversely affect the quality of the ultimate developed images. For example, non-uniform charging distances can manifest as variations in high background deposits during development of electrostatic latent images near the edges of paper. Since the anticurl back coating is an outermost exposed backing layer and has high surface contact friction when it slides over the machine subsystems of belt support module, such as rollers, stationary belt guiding components, and backer bars, during dynamic belt cyclic function, these mechanical sliding interactions against the belt support module components not only exacerbate anticurl back coating wear, it does also cause the relatively rapid wearing away of the anti-curl produce debris which scatters and deposits on critical machine components such as lenses, corona charging devices and the like, thereby adversely affecting machine performance. Moreover, anticurl back coating abrasion/scratch damage does also produce unbalance forces generation between the charge transport layer and the anticurl back coating to cause micro belt ripples formation during electrophotographic imaging processes, resulting in streak line print defects in output copies to deleteriously impact image printout quality and shorten the imaging member belt functional life.

Undesirably, high contact friction of the anticurl back coating against machine subsystems is further seen to cause the development of electrostatic charge built-up problem. In other machines the electrostatic charge builds up due to contact friction between the anti-curl layer and the backer bars increases the friction and thus requires higher torque to pull the belts. In full color machines with 10 pitches this can be extremely high due to large number of backer bars used. At times, one has to use two drive rollers rather than one which are to be coordinated electronically precisely to keep any possibility of sagging. Static charge built-up in anticurl back coating increases belt drive torque, in some instances, has also been found to result in absolute belt stalling. In other cases, the electrostatic charge build up can be so high as to cause sparking.

Another problem encountered in the conventional belt photoreceptors using a bisphenol A polycarbonate anticurl back coating that are extensively cycled in precision electrostatographic imaging machines utilizing belt supporting backer bars, is an audible squeaky sound generated due to high contact friction interaction between the anticurl back coating and the backer bars. Further, cumulative deposition of anticurl back coating wear debris onto the backer bars may give rise to undesirable defect print marks formed on copies because each debris deposit become a surface protrusion point on the backer bar and locally forces the imaging member belt upwardly to interferes with the toner image development process. On other occasions, the anticurl back coating wear debris accumulation on the backer bars does gradually increase the dynamic contact friction between these two interacting surfaces of anticurl back coating and backer bar, interfering with the duty cycle of the driving motor to a point where the motor eventually stalls and belt cycling prematurely ceases. Additionally, it is important to point out that electrophotographic imaging member belts prepared that required anticurl back coating to provide flatness have more than above list of problems, they do indeed incur additional material and labor cost impact to imaging members' production process.

Thus, electrophotographic imaging members comprising a supporting substrate, having a conductive surface on one side, coated over with at least one photoconductive layer (such as the outermost charge transport layer) and coated on the other side of the supporting substrate with a conventional anticurl back coating that does exhibit deficiencies which are undesirable in advanced automatic, cyclic electrophotographic imaging copiers, duplicators, and printers. While the above mentioned electrophotographic imaging members may be suitable or limited for their intended purposes, further improvement on these imaging members are required. For example, there continues to be the need for improvements in such systems, particularly for an imaging member belt that has sufficiently flatness, reduces friction, has superb wear resistance, provides lubricity to ease belt drive, nil or no wear debris, and eliminates electrostatic charge build-up problem, even in larger printing apparatuses. With many of above mentioned shortcomings and problems associated with electrohotographic imaging members having an anticurl back coating now understood, therefore there is an urgent need to resolve these issues through the development of a methodology for fabricating imaging members that produce improve function and meet future machine imaging member belt life extension need. In the present disclosure, a charge transport layer material reformulation method and process of making a flexible imaging member free of the mentioned deficiencies have been identified and demonstrated through the preparation of anticurl back coating free imaging member. The improved curl-free imaging member without the need of a conventional anticurl back coating suppresses abrasion/wear failure and extend the charge transport layer cracking will be described in detail in the following.

Conventional photoreceptors are disclosed in the following patents, a number of which describe the presence of light scattering particles in the undercoat layers: Yu, U.S. Pat. No. 5,660,961; Yu, U.S. Pat. No. 5,215,839; and Katayama et al., U.S. Pat. No. 5,958,638. The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

Yu, U.S. Pat. No.6,660,441, issued on Dec. 9, 2003, discloses an electrophotographic imaging member having a substrate support material which eliminates the need of an anticurl backing layer, a substrate support layer and a charge transport layer having a thermal contraction coefficient difference in the range of from about $-2\times10^{-5}$/° C. to about $+2\times10^{-5}$/° C., a substrate support material having a glass transition temperature (Tg) of at least 100° C., wherein the substrate support material is not susceptible to the attack from the charge transport layer coating solution solvent and wherein the substrate support material is represented by two specifically selected polyimides.

In U.S. Pat. No. 7,413,835 issued on Aug. 19, 2008, it discloses an electrophotographic imaging member having a thermoplastic charge transport layer, a polycarbonate polymer binder, a particulate dispersion, and a high boiler compatible liquid. The disclosed charge transport layer exhibits enhanced wear resistance, excellent photoelectrical properties, and good print quality.

In U.S. Publication No. 2006/0099525, discloses an imaging member formulated with a liquid carbonate. The imaging electrostatographic member exhibits improved service life.

SUMMARY

According to aspects illustrated herein, there is provided an imaging member comprising a substrate, a charge generating layer disposed on the substrate, and at least one charge transport layer disposed on the charge generating layer, wherein the charge transport layer comprises a polycarbonate, a charge transport compound of N,N'-diphenyl-N,N'-bis(3-methylphenyl)-1,1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

In another embodiment, there is provided an imaging member comprising a substrate, and a single imaging layer disposed on the substrate, wherein the single imaging layer disposed on the substrate has both charge generating and charge transporting capability and further wherein the single imaging layer comprises a polycarbonate, N,N'-diphenyl-N,N'-bis(3-methylphenyl)-1,1-biphenyl-4,4'-diamine, and a liquid compound having a high boiling point and being miscible with both the polycarbonate and N,N'-diphenyl-N,N'-bis(3-methylphenyl)-1,1-biphenyl-4,4'-diamine.

In yet a further embodiment, there is provided an imaging member comprising a substrate, and a single imaging layer disposed on the substrate, wherein the single imaging layer disposed on the substrate has both charge generating and charge transporting capability and the single imaging layer comprises a polycarbonate, N,N'-diphenyl-N,N'-bis(3-methylphenyl)-1,1-biphenyl-4,4'-diamine, and a liquid compound having a high boiling point and being miscible with both the polycarbonate and N,N'-diphenyl-N,N'-bis(3-methylphenyl)-1,1-biphenyl-4,4'-diamine, and further wherein the imaging member has a diameter of curvature of about 25 inches or more.

BRIEF DESCRIPTION OF THE DRAWINGS

For a better understanding of the present disclosure, reference may be had to the accompanying figures.

DETAILED DESCRIPTION

Figure 1:
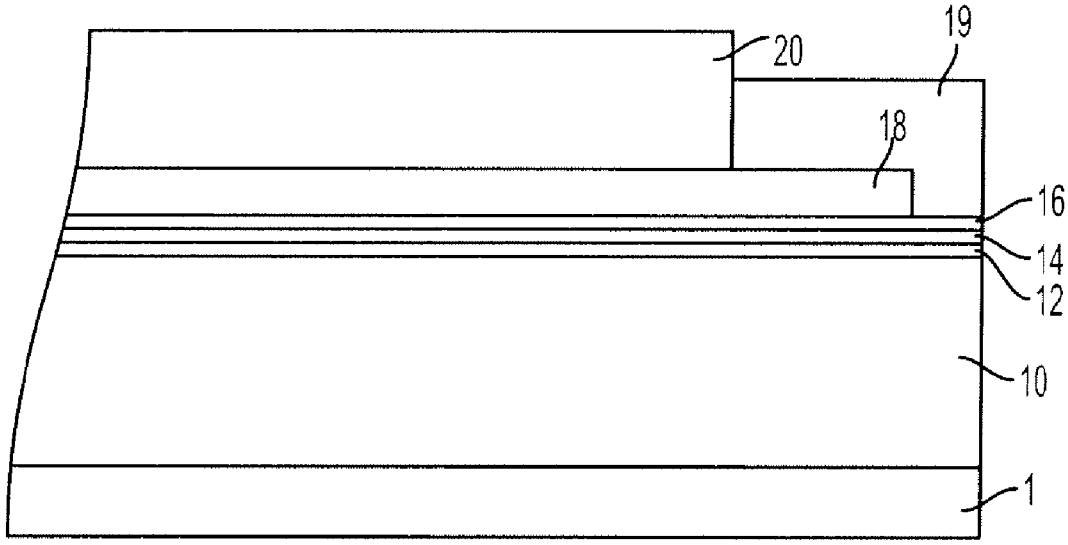
FIG. 1 is a cross-sectional view of a flexible multilayered electrophotographic imaging member having the configuration and structural design according to the conventional description.

In the following description, reference is made to the accompanying drawings, which form a part hereof and which illustrate several embodiments. It is understood that other embodiments may be utilized and structural and operational changes may be made without departure from the scope of the present embodiments.

According to aspects illustrated herein, there is a curl-free flexible imaging member comprising a flexible substrate, a conductive ground plane, a hole blocking layer, a charge generation layer, and an outermost charge transport layer without the application of an anti-curl back coating layer disposed onto the substrate on the side opposite of the charge transport layer; wherein, the charge transport layer is formulated to have minima internal build-in strain by incorporation of a suitable liquid plasticizer. To achieve the intended charge transport layer plasticizing resulting for anticurl back coating free imaging member preparation, two high boiler liquid candidates are chosen for present disclosure application, as further described below.

The oligomeric polystyrene liquid chosen for charge transport layer plasticizing use has a molecular structure shown in Formula (I) below:

Formula (I)

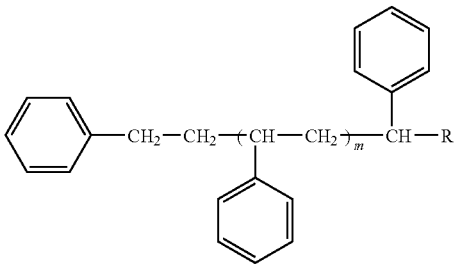

where R is selected from the group consisting of H, $CH_3$, $CH_2CH_3$, and $CH_2OCOOCH_3$; while m is between 0 and 10.

The plasticizing liquid monomer carbonate used for charge transport layer incorporation is represented by monomeric bisphenol A carbonate and has the following molecular Formula (II):

Formula (II)

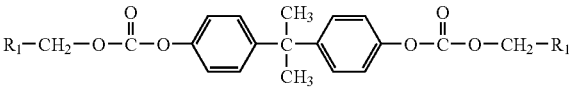

Where $R_1$ is H, $CH_3$, $CH_2CH_3$, and $CH_2OCOOCH_3$

Other aromatic carbonate liquids that are viable candidates for charge transport layer plasticizing may also be derived from Formula (I) and included for the present disclosure application. Their molecular structures are represented by Formulas (III) to (V) below:

Formula (III)

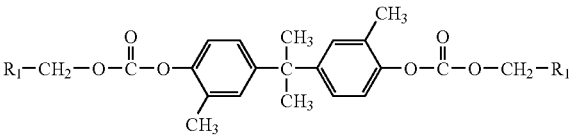

Formula (IV)

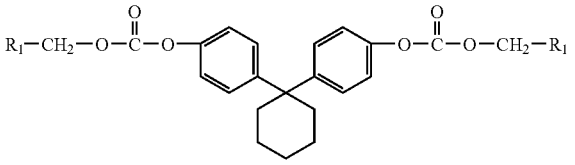

Formula (V)

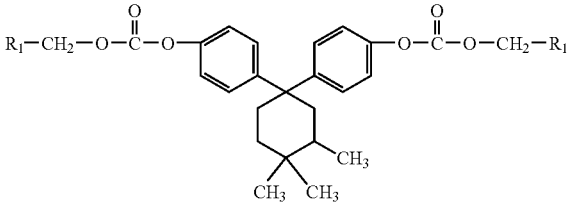

where $R_1$ in all these formulas is selected from the group consisting of H, $CH_3$, $CH_2CH_3$, and $CH_2OCOOCH_3$.

The selection of oligomeric polystyrene and monomer carbonate for imaging member charge transport layer plasticizing is based on the facts that they are (a) high boiler liquids with boiling point exceeding 300° C. so their presence in the charge transport layer to effect plasticizing outcome will be permanent and (b) of liquids totally miscible/compatible with both the charge transporting compound and the polymer binder such that their incorporation into the charge transport layer material matrix should cause no deleterious photoelectrical function of the resulting imaging member.

In one specific embodiment, it is provided a substantially curl-free imaging member comprising a flexible imaging member comprising a substrate, a conductive ground plane, a hole blocking layer, a charge generation layer, and an outermost charge transport layer comprising a polycarbonate binder, charge transporting molecules, and a liquid oligomeric polystyrene.

In another specific embodiment, it is provided a substantially curl-free imaging member comprising a flexible imaging member comprising a substrate, a conductive ground plane, a hole blocking layer, a charge generation layer, and an outermost charge transport layer comprising a polycarbonate binder, charge transporting molecules, and a liquid monomer carbonate.

In yet another specific embodiment, it is provided a substantially curl-free imaging member comprising a flexible imaging member comprising a substrate, a conductive ground plane, a hole blocking layer, a charge generation layer, and an outermost charge transport layer comprising a polycarbonate binder, charge transporting molecules, In another specific embodiment, it is provided a substantially curl-free imaging member comprising a flexible imaging member comprising a substrate, a conductive ground plane, a hole blocking layer, a charge generation layer, and an outermost charge transport layer comprising a polycarbonate binder, charge transporting molecules, a mixture of liquid oligomeric polystyrene and liquid monomer carbonate.

An exemplary embodiment of a conventional negatively charged flexible electrophotographic imaging member is illustrated in FIG. 1. The substrate 10 has an optional conductive layer 12. An optional hole blocking layer 14 disposed onto the conductive layer 12 is coated over with an optional adhesive layer 16 The charge generating layer 18 is located between the adhesive layer 16 and the charge transport layer 20. An optional ground strip layer 19 operatively connects the charge generating layer 18 and the charge transport layer 20 to the conductive ground plane 12, and an optional overcoat layer 32 is applied over the charge transport layer 20. An anti-curl backing layer 1 is applied to the side of the substrate 10 opposite from the electrically active layers to render imaging member flatness.

The layers of the imaging member include, for example, an optional ground strip layer 19 that is applied to one edge of the imaging member to promote electrical continuity with the conductive ground plane 12 through the hole blocking layer 14. The conductive ground plane 12, which is typically a thin metallic layer, for example a 10 nanometer thick titanium coating, may be deposited over the substrate 10 by vacuum deposition or sputtering process. The other layers 14, 16, 18, 20 and 43 are to be separately and sequentially deposited, onto to the surface of conductive ground plane 12 of substrate 10 respectively, as wet coating layer of solutions comprising a solvent, with each layer being dried before deposition of the next subsequent one. An anticurl back coating layer 1 may then be formed on the backside of the support substrate 1. The anticurl back coating 1 is also solution coated, but is applied to the back side (the side opposite to all the other layers) of substrate 1, to render imaging member flatness.

The Substrate

The imaging member support substrate 10 may be opaque or substantially transparent, and may comprise any suitable organic or inorganic material having the requisite mechanical properties. The entire substrate can comprise the same material as that in the electrically conductive surface, or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. It could be single metallic compound or dual layers of different metals and or oxides.

The support substrate 10 can also be formulated entirely of an electrically conductive material, or it can be an insulating material including inorganic or organic polymeric materials, such as, MYLAR, a commercially available biaxially oriented polyethylene terephthalate from DuPont, or polyethylene naphthalate (PEN) available as KALEDEX 2000, with a ground plane layer comprising a conductive titanium or titanium/zirconium coating, otherwise a layer of an organic or inorganic material having a semiconductive surface layer, such as indium tin oxide, aluminum, titanium, and the like, or exclusively be made up of a conductive material such as, aluminum, chromium, nickel, brass, other metals and the like. The thickness of the support substrate depends on numerous factors, including mechanical performance and economic considerations. The substrate may have a number of many different configurations, such as, for example, a plate, a drum, a scroll, an endless flexible belt, and the like. In one embodiment, the substrate is in the form of a seamed flexible belt.

The thickness of the support substrate 10 depends on numerous factors, including flexibility, mechanical performance, and economic considerations. The thickness of the support substrate may range from about 50 micrometers to about 3,000 micrometers. In embodiments of flexible imaging member belt preparation, the thickness of substrate used is from about 50 micrometers to about 200 micrometers for achieving optimum flexibility and to effect tolerable induced imaging member belt surface bending stress/strain when a belt is cycled around small diameter rollers in a machine belt support module, for example, the 19 millimeter diameter rollers.

An exemplary functioning support substrate 10 is not soluble in any of the solvents used in each coating layer solution, has good optical transparency, and is thermally stable up to a high temperature of at least 150° C. A typical support substrate 10 used for imaging member fabrication has a thermal contraction coefficient ranging from about $1\times10^{-5}$° C. to about $3\times10^{-5}$° C. and a Young's Modulus of between about $5\times10^{-5}$ psi ($3.5\times10^{-4}$ Kg/cm2) and about $7\times10^{-5}$ psi ($4.9\times10^{-4}$Kg/cm2).

The Conductive Ground Plane

The conductive ground plane layer 12 may vary in thickness depending on the optical transparency and flexibility desired for the electrophotographic imaging member. For a typical flexible imaging member belt, it is desired that the thickness of the conductive ground plane 12 on the support substrate 10, for example, a titanium and/or zirconium conductive layer produced by a sputtered deposition process, is in the range of from about 2 nanometers to about 75 nanometers to effect adequate light transmission through for proper back erase. And preferably, it is from about 10 nanometers to about 20 nanometers to provide optimum combination of electrical conductivity, flexibility, and light transmission. For electrophotographic imaging process employing back exposure erase approach, a conductive ground plane light transparency of at least about 15 percent is generally desirable. The conductive ground plane need is not limited to metals. Nonetheless, the conductive ground plane 12 has usually been an electrically conductive metal layer which may be formed, for example, on the substrate by any suitable coating technique, such as a vacuum depositing or sputtering technique. Typical metals suitable for use as conductive ground plane include aluminum, zirconium, niobium, tantalum, vanadium, hafnium, titanium, nickel, stainless steel, chromium, tungsten, molybdenum, combinations thereof, and the like. Other examples of conductive ground plane 12 may be combinations of materials such as conductive indium tin oxide as a transparent layer for light having a wavelength between about 4000 Angstroms and about 9000 Angstroms or a conductive carbon black dispersed in a plastic binder as an opaque conductive layer. However, in the event where the entire substrate is chosen to be an electrically conductive metal, such as in the case that the electrophotographic imaging process designed to use front exposure erase, the outer surface thereof can perform the function of an electrically conductive ground plane so that a separate electrical conductive layer 12 may be omitted.

For the reason of convenience, all the illustrated embodiments herein after will be described in terms of a substrate layer 10 comprising an insulating material including organic polymeric materials, such as, MYLAR or PEN having a conductive ground plane 12 comprising of an electrically conductive material, such as titanium or titanium/zirconium, coating over the support substrate 10.

The Hole Blocking Layer

A hole blocking layer 14 may then be applied to the conductive ground plane 12 of the support substrate 10. Any suitable positive charge (hole) blocking layer capable of forming an effective barrier to the injection of holes from the adjacent conductive layer 12 into the overlaying photoconductive or photogenerating layer may be utilized. The charge (hole) blocking layer may include polymers, such as, polyvinylbutyral, epoxy resins, polyesters, polysiloxanes, polyamides, polyurethanes, HEMA, hydroxylpropyl cellulose, polyphosphazine, and the like, or may comprise nitrogen containing siloxanes or silanes, or nitrogen containing titanium or zirconium compounds, such as, titanate and zirconate. The hole blocking layer 14 may have a thickness in wide range of from about 5 nanometers to about 10 micrometers depending on the type of material chosen for use in a photoreceptor design. Typical hole blocking layer materials include, for example, trimethoxysilyl propylene diamine, hydrolyzed trimethoxysilyl propyl ethylene diamine, N-beta-(aminoethyl) gamma-aminopropyl trimethoxy silane, isopropyl 4-aminobenzene sulfonyl di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethylethylamino)titanate, titanium-4-amino benzene sulfonate oxyacetate, titanium 4-aminobenzoate isostearate oxyacetate, (gamma-aminobutyl) methyl diethoxysilane which has the formula [H2N(CH2)4]CH3Si(OCH3)2, and (gamma-aminopropyl) methyl diethoxysilane, which has the formula [H2N(CH2)3]CH33Si(OCH3)2, and combinations thereof, as disclosed, for example, in U.S. Pat. Nos. 4,338,387; 4,286,033; and 4,291,110, incorporated herein by reference in their entireties. A preferred hole blocking layer comprises a reaction product between a hydrolyzed silane or mixture of hydrolyzed silanes and the oxidized surface of a metal ground plane layer. The oxidized surface inherently forms on the outer surface of most metal ground plane layers when exposed to air after deposition. This combination enhances electrical stability at low RH. Other suitable charge blocking layer polymer compositions are also described in U.S. Pat. No. 5,244,762 which is incorporated herein by reference in its entirety. These include vinyl hydroxyl ester and vinyl hydroxy amide polymers wherein the hydroxyl groups have been partially modified to benzoate and acetate esters which modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597, which is incorporated herein by reference in its entirety. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of these U.S. Patents are incorporated herein by reference in their entireties.

The hole blocking layer 14 can be continuous or substantially continuous and may have a thickness of less than about 10 micrometers because greater thicknesses may lead to undesirably high residual voltage. In aspects of the exemplary embodiment, a blocking layer of from about 0.005 micrometers to about 2 micrometers gives optimum electrical performance. The blocking layer may be applied by any suitable conventional technique, such as, spraying, dip coating, draw bar coating, gravure coating, silk screening, air knife coating, reverse roll coating, vacuum deposition, chemical treatment, and the like. For convenience in obtaining thin layers, the blocking layer may be applied in the form of a dilute solution, with the solvent being removed after deposition of the coating by conventional techniques, such as, by vacuum, heating, and the like. Generally, a weight ratio of blocking layer material and solvent of between about 0.05:100 to about 5:100 is satisfactory for spray coating.

The Adhesive Interface Layer

An optional separate adhesive interface layer 16 may be provided. In the embodiment illustrated in FIG. 1, an interface layer 16 is situated intermediate the blocking layer 14 and the charge generator layer 18. The adhesive interface layer 16 may include a copolyester resin. Exemplary polyester resins which may be utilized for the interface layer include polyarylatepolyvinylbutyrals, such as ARDEL POLYARYLATE (U-100) commercially available from Toyota Hsutsu Inc., VITEL PE-1200, VITEL PE-2200, VITEL PE-2200D, and VITEL PE-2222, all from Bostik, 49,000 polyester from Rohm Hass, polyvinyl butyral, and the like. The adhesive interface layer 16 may be applied directly to the hole blocking layer 14. Thus, the adhesive interface layer 16 in embodiments is in direct contiguous contact with both the underlying hole blocking layer 14 and the overlying charge generator layer 18 to enhance adhesion bonding to provide linkage. However, in some alternative electrophotographic imaging member designs, the adhesive interface layer 16 is entirely omitted.

Any suitable solvent or solvent mixtures may be employed to form a coating solution of the polyester for the adhesive interface layer 36. Typical solvents include tetrahydrofuran, toluene, monochlorbenzene, methylene chloride, cyclohexanone, and the like, and mixtures thereof. Any other suitable and conventional technique may be used to mix and thereafter apply the adhesive layer coating mixture to the hole blocking layer. Typical application techniques include spraying, dip coating, roll coating, wire wound rod coating, and the like. Drying of the deposited wet coating may be effected by any suitable conventional process, such as oven drying, infra red radiation drying, air drying, and the like.

The adhesive interface layer 16 may have a thickness of from about 0.01 micrometers to about 900 micrometers after drying. In embodiments, the dried thickness is from about 0.03 micrometers to about 1 micrometer.

The Charge Generating Layer

The photogenerating (e.g., charge generating) layer 18 may thereafter be applied to the adhesive layer 16. Any suitable charge generating binder layer 18 including a photogenerating/photoconductive material, which may be in the form of particles and dispersed in a film forming binder, such as an inactive resin, may be utilized. Examples of photogenerating materials include, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, hydroxy gallium phthalocyanines, chlorogallium phthalocyanines, titanyl phthalocyanines, quinacridones, dibromo anthanthrone pigments, benzimidazole perylene, substituted 2,4-diamino-triazines, polynuclear aromatic quinones, and the like dispersed in a film forming polymeric binder. Selenium, selenium alloy, benzimidazole perylene, and the like and mixtures thereof may be formed as a continuous, homogeneous photogenerating layer. Benzimidazole perylene compositions are well known and described, for example, in U.S. Pat. No. 4,587,189, the entire disclosure thereof being incorporated herein by reference. Multi-photogenerating layer compositions may be utilized where a photoconductive layer enhances or reduces the properties of the photogenerating layer. Other suitable photogenerating materials known in the art may also be utilized, if desired. The photogenerating materials selected should be sensitive to activating radiation having a wavelength between about 400 and about 900 nm during the imagewise radiation exposure step in an electrophotographic imaging process to form an electrostatic latent image. For example, hydroxygallium phthalocyanine absorbs light of a wavelength of from about 370 to about 950 nanometers, as disclosed, for example, in U.S. Pat. No. 5,756,245.

Any suitable inactive resin materials may be employed as a binder in the photogenerating layer 18, including those described, for example, in U.S. Pat. No. 3,121,006, the entire disclosure thereof being incorporated herein by reference. Typical organic resinous binders include thermoplastic and thermosetting resins such as one or more of polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride/vinylchloride copolymers, vinylacetate/vinylidene chloride copolymers, styrene-alkyd resins, and the like.

An exemplary film forming polymer binder is PCZ-400 (poly(4,4'-dihydroxy-diphenyl-1-1-cyclohexane) which has a MW=40,000 and is available from Mitsubishi Gas Chemical Corporation.

The photogenerating material can be present in the resinous binder composition in various amounts. Generally, from about 5 percent by volume to about 90 percent by volume of the photogenerating material is dispersed in about 10 percent by volume to about 95 percent by volume of the resinous binder, and more specifically from about 20 percent by volume to about 30 percent by volume of the photo generating material is dispersed in about 70 percent by volume to about 80 percent by volume of the resinous binder composition.

The photogenerating layer 18 containing the photogenerating material and the resinous binder material generally ranges in thickness of from about 0.1 micrometer to about 5 micrometers, for example, from about 0.3 micrometers to about 3 micrometers when dry. The photogenerating layer thickness is generally related to binder content. Higher binder content compositions generally employ thicker layers for photogeneration.

The Ground Strip Layer

Other layers such as conventional ground strip layer 19 including, for example, conductive particles dispersed in a film forming binder may be applied to one edge of the imaging member to promote electrical continuity with the conductive ground plane 12 through the hole blocking layer 14. Ground strip layer may include any suitable film forming polymer binder and electrically conductive particles. Typical ground strip materials include those enumerated in U.S. Pat. No. 4,664,995, the entire disclosure of which is incorporated by reference herein. The ground strip layer 19 may have a thickness from about 7 micrometers to about 42 micrometers, for example, from about 14 micrometers to about 23 micrometers.

The Charge Transport Layer

The charge transport layer 20 is thereafter applied over the charge generating layer 18 and become, as shown in FIG. 1, the exposed outermost layer of the imaging member. It may include any suitable transparent organic polymer or non-polymeric material capable of supporting the injection of photogenerated holes or electrons from the charge generating layer 18 and capable of allowing the transport of these holes/electrons through the charge transport layer to selectively discharge the surface charge on the imaging member surface. In one embodiment, the charge transport layer 20 not only serves to transport holes, but also protects the charge generating layer 18 from abrasion or chemical attack and may therefore extend the service life of the imaging member. The charge transport layer 20 can be a substantially non-photoconductive material, but one which supports the injection of photogenerated holes from the charge generation layer 18. The charge transport layer 20 is normally transparent in a wavelength region in which the electrophotographic imaging member is to be used when exposure is effected therethrough to ensure that most of the incident radiation is utilized by the underlying charge generating layer 18. The charge transport layer should exhibit excellent optical transparency with negligible light absorption and neither charge generation nor discharge if any, when exposed to a wavelength of light useful in xerography, e.g., 400 to 900 nanometers. In the case when the imaging member is prepared with the use of a transparent support substrate 10 and also a transparent conductive ground plane 12, image wise exposure or erase may be accomplished through the substrate 10 with all light passing through the back side of the support substrate 10. In this particular case, the materials of the charge transport layer 20 need not have to be able to transmit light in the wavelength region of use for electrophotographic imaging processes if the charge generating layer 18 is sandwiched between the support substrate 10 and the charge transport layer 20. In all events, the exposed outermost charge transport layer 20 in conjunction with the charge generating layer 18 is an insulator to the extent that an electrostatic charge deposited/placed over the charge transport layer is not conducted in the absence of radiant illumination. Importantly, the charge transport layer 20 should trap minimal or no charges as the charge pass through it during the image copying/printing process.

The charge transport layer 20 may include any suitable charge transport component or activating compound useful as an additive molecularly dispersed in an electrically inactive polymeric material to form a solid solution and thereby making this material electrically active. The charge transport component may be added to a film forming polymeric material which is otherwise incapable of supporting the injection of photo generated holes from the generation material and incapable of allowing the transport of these holes there through. This converts the electrically inactive polymeric material to a material capable of supporting the injection of photogenerated holes from the charge generation layer 18 and capable of allowing the transport of these holes through the charge transport layer 20 in order to discharge the surface charge on the charge transport layer. The charge transport component typically comprises small molecules of an organic compound which cooperate to transport charge between molecules and ultimately to the surface of the charge transport layer.

Any suitable inactive resin binder soluble in methylene chloride, chlorobenzene, or other suitable solvent may be employed in the charge transport layer. Exemplary binders include polyesters, polyvinyl butyrals, polycarbonates, polystyrene, polyvinyl formals, and combinations thereof. The polymer binder used for the charge transport layers may be, for example, selected from the group consisting of polycarbonates, poly(vinyl carbazole), polystyrene, polyester, polyarylate, polyacrylate, polyether, polysulfone, combinations thereof, and the like. Exemplary polycarbonates include poly (4,4'-isopropylidene diphenyl carbonate), poly(4,4'-diphenyl-1,1'-cyclohexane carbonate), and combinations thereof. The molecular weight of the polymer binder used in the charge transport layer can be, for example, from about 20,000 to about 1,500,000.

Exemplary charge transport components include aromatic polyamines, such as aryl diamines and aryl triamines. Exemplary aromatic diamines include N,N'-diphenyl-N,N'-bis (alkylphenyl)-1,1'-biphenyl-4,4-diamines, such as mTBD, which has the formula (N,N'-diphenyl-N,N'-bis[3-methylphenyl]-[1,1'-biphenyl]-4,4'-diamine); N,N'-diphenyl-N, N'-bis(chlorophenyl)-1,1'-biphenyl-4,4'-diamine; and N,N'-bis-(4-methylphenyl)-N,N'-bis(4-ethylphenyl)-1,1 '-3,3'-dimethylbiphenyl)-4,4'-diamine (Ae-16), N,N'-bis-(3,4-dimethylphenyl)-4,4'-biphenyl amine (Ae-18), and combinations thereof.

Other suitable charge transport components include pyrazolines, such as 1-[epidyl-(2)]-3-(p-diethylaminophenyl)-5-(p-diethylaminophenyl)pyrazoline, as described, for example, in U.S. Pat. Nos. 4,315,982, 4,278,746, 3,837,851, and 6,214,514, substituted fluorene charge transport molecules, such as 9-(4'-dimethylaminobenzylidene)fluorene, as described in U.S. Pat. Nos. 4,245,021 and 6,214,514, oxadiazole transport molecules, such as 2,5-bis(4-diethylaminophenyl)-1,3,4-oxadiazole, pyrazoline, imidazole, triazole, as described, for example in U.S. Pat. No. 3,895,944, hydrazones, such as p-diethylaminobenzaldehyde (diphenylhydrazone), as described, for example in U.S. Pat. Nos. 4,150,987 4,256,821, 4,297,426, 4,338,388, 4,385,106, 4,387,147, 4,399,207, 4,399,208, 6,124,514, and tri-substituted methanes, such as alkyl-bis(N,N-dialkylaminoaryl)methanes, as described, for example, in U.S. Pat. No. 3,820,989. The disclosures of all of these patents are incorporated herein be reference in their entireties.

The concentration of the charge transport component in layer 20 may be, for example, at least about 5 weight % and may comprise up to about 60 weight %. The concentration or composition of the charge transport component may vary through layer 20, as disclosed, for example, in U.S. Pat. Nos. 7,033,714; 6,933,089; and 7,018,756, the disclosures of which are incorporated herein by reference in their entireties.

In one exemplary embodiment, charge transport layer 20 comprises an average of about 10 to about 60 weight percent N,N'-diphenyl-N,N'-bis(3-methylphenyl)-1,1'-biphenyl-4, 4'-diamine, and preferably as from about 30 to about 50 weight percent N,N'-diphenyl-N,N'-bis(3-methylphenyl)-1,1 '-biphenyl-4,4'-diamine.

The charge transport layer 20 is an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer 20 to the charge generator layer 18 is maintained from about 2:1 to about 200:1 and in some instances as great as about 400:1.

Additional aspects relate to the inclusion in the charge transport layer 20 of variable amounts of an antioxidant, such as a hindered phenol. Exemplary hindered phenols include octadecyl-3,5-di-tert-butyl-4-hyd roxyhyd rociannamate, available as IRGANOX I-1010 from Ciba Specialty Chemicals. The hindered phenol may be present at about 10 weight percent based on the concentration of the charge transport component. Other suitable antioxidants are described, for example, in above-mentioned U.S. Pat. No. 7,018,756, incorporated by reference.

In one specific embodiment, the charge transport layer 20 is a solid solution including a charge transport component, such as N,N'-diphenyl-N,N'-bis(3-methylphenyl)-1,1'-biphenyl-4,4'-diamine, molecularly dissolved in a polycarbonate binder, the binder being either a Bisphenol A polycarbonate of poly(4,4'-isopropylidene diphenyl carbonate) or a poly(4, 4'-diphenyl-1,1'-cyclohexane carbonate). The Bisphenol A polycarbonate used for typical charge transport layer formulation is MAKROLON which is commercially available from Farbensabricken Bayer A.G and has a molecular weight of about 120,000. The molecular structure of Bisphenol A polycarbonate, poly(4,4'-isopropylidene diphenyl carbonate), is given in Formula (A) below:

Formula (A)

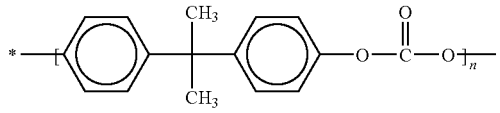

wherein n indicates the degree of polymerization. In the alternative, poly(4,4'-diphenyl-1,1'-cyclohexane carbonate) may also be used to for the anticurl back coating in place of MAKROLON. The molecular structure of poly(4,4'-diphenyl-1,1'-cyclohexane carbonate), having a weight average molecular weight of about between about 20,000 and about 200,000, is given in Formula (B) below:

Formula (B)

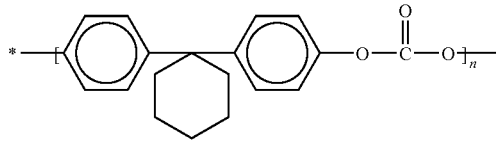

wherein n indicates the degree of polymerization.

The charge transport layer 20 may have a Young's Modulus in the range of from about 2.5×10−5 psi (1.7×10−4 Kg/cm2) to about 4.5×10−5 psi (3.2×10−4 Kg/cm2) and a thermal contraction coefficient of between about 6×10−5° C. and about 8×10−5° C.

Since the charge transport layer 20 can have a substantially greater thermal contraction coefficient constant compared to that of the support substrate 10, the prepared flexible electrophotographic imaging member will typically exhibit spontaneous upward curling, into a 1½ inch roll if unrestrained, due to the result of larger dimensional contraction in the charge transport layer 20 than the support substrate 10, as the imaging member cools from its $Tg_{CTL}$ down to room ambient temperature of 25° C. after the heating/drying processes of the applied wet charge transport layer coating. Therefore, internal tensile pulling strain is build-in in the charge transport layer and can be expressed in equation (1) below:

$$\epsilon=(\alpha_{CTL}-\alpha_{sub})(Tg_{CTL}-25^\circ\text{ C.}) \quad (1)$$

where $\epsilon$ is the internal strain build-in in the charge transport layer, $\alpha_{CTL}$ and $\alpha_{sub}$ are coefficient of thermal contraction of charge transport layer and substrate respectively, and $Tg_{CTL}$ is the glass transition temperature of the charge transport layer. Therefore, equation (1), had indicated that to suppress or control the imaging member upward curling, decreasing the $Tg_{CTL}$ of the charge transport layer is indeed the key to minimize the charge transport layer strain and impact the imaging member flatness.

An anti-curl back coating 1 can be applied to the back side of the support substrate 10 (which is the side opposite the side bearing the electrically active coating layers) in order to render the prepared imaging member with desired flatness.

The Anticurl Back Coating

Since the charge transport layer 20 is applied by solution coating process, the applied wet film is dried at elevated temperature and then subsequently cooled down to room ambient. The resulting imaging member web if, at this point, not restrained, will spontaneously curl upwardly into a 1½ inch tube due to greater dimensional contraction and shrinkage of the Charge transport layer than that of the substrate support layer 10. An anti-curl back coating 1, as the conventional imaging member shown in FIG. 1, is then applied to the back side of the support substrate 10 (which is the side opposite the side bearing the electrically active coating layers) in order to render the prepared imaging member with desired flatness.

Generally, the anticurl back coating 1 comprises a thermoplastic polymer and an adhesion promoter. The thermoplastic polymer, preferably being the same as the polymer binder used in the charge transport layer, is typically a bisphenol A polycarbonate, which along with the addition of an adhesion promoter of polyester are both dissolved in a solvent to form an anticurl back coating solution. The coated anticurl back coating 1 must adhere well to the support substrate 10 to prevent premature layer delamination during imaging member belt machine function in the field.

In a conventional anticurl back coating, an adhesion promoter of copolyester is included in the bisphenol A polycarbonate poly(4,4'-isopropylidene diphenyl carbonate) material matrix to provide adhesion bonding enhancement to the substrate support. Satisfactory adhesion promoter content is from about 0.2 percent to about 20 percent but preferably from about 2 percent to about 10 percent by weight, based on the total weight of the anticurl back coating The adhesion promoter may be any known in the art, such as for example, VITEL PE2200 which is available from Bostik, Inc. (Middleton, Mass.). The anticurl back coating has a thickness that is adequate to counteract the imaging member upward curling and provide flatness; so, it is of from about 5 micrometers to about 50 micrometers, but preferably between about 10 micrometers and about 20 micrometers. A typical, conventional anticurl back coating formulation is a 92:8 ratio of polycarbonate to adhesive.

Figure 2A:
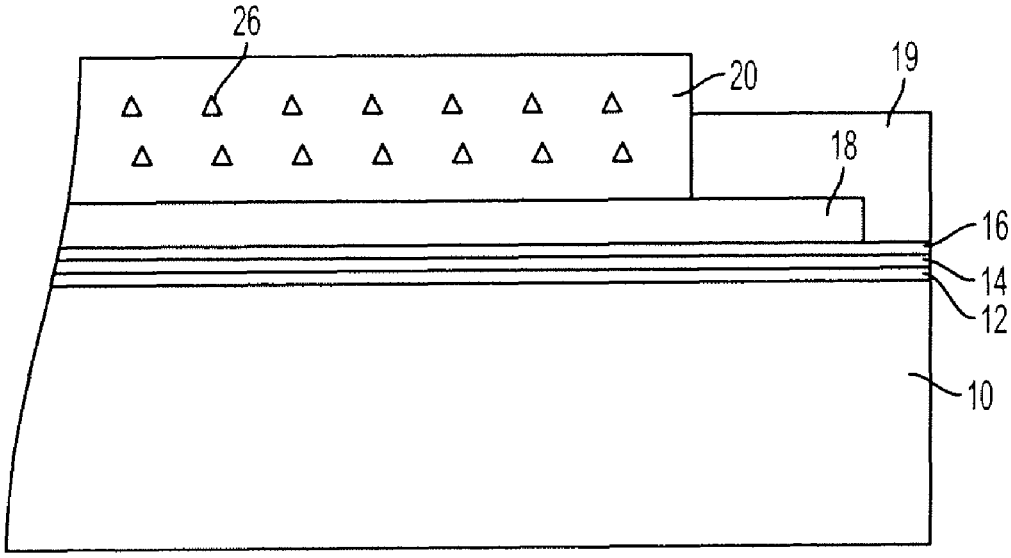
FIG. 2A is a cross-sectional view of a structurally simplified flexible multilayered electrophotographic imaging member having a single charge transport layer according to an embodiment of the present disclosure.

FIG. 2A discloses the imaging member prepared according to the material formulation and methodology of the present disclosure. In the embodiments, the substrate 10, conductive ground plane 12, hole blocking layer, 14, adhesive interface layer 16, charge generating layer 18, of the disclosed imaging member (containing no anticurl back coating) are prepared to have very exact same materials, compositions, dimensions, and procedures as those described in the conventional imaging member of FIG. 1, but with the exception that the charge transport layer 20 is reformulated to include an oligomeric polystyrene liquid 26 plasticizer incorporation in the charge transport layer 20, to effect its internal strain elimination and thereby render the resulting imaging member with desirable flatness without the need of the anticurl back coating. In essence, the presence of the plasticizer liquid in the layer material matrix, the Tg of the plasticized charge transport layer is therefore substantially depressed, such that the magnitude of (Tg−25° C.) becomes a small value to decrease charge transport layer internal strain, according to equation (1), and effect imaging member curling reduction. The reformulated charge transport layer 20 comprises an average of about 10 to about 60 weight percent of a diamine charge transporting compound such as mTBD (N,N'-diphenyl-N,N'-bis[3-methylphenyl]-[1,1'-biphenyl]-4,4'-diamine), about 10 to about 90 bisphenol A polycarbonate poly(4,4'-isopropylidene diphenyl carbonate), and the addition of a plasticizing oligomeric styrene liquid. The content of this plasticizing liquid is in a range of from about 3 to about 30 weight percent and preferably between about 10 and about 20 weight percent with respect to the summation weight of N,N'-diphenyl-N,N'-bis(3-methylphenyl)-1,1-biphenyl-4,4'-diamine (m-TBD) and the polycarbonate. The molecular formula of the oligomeric polystyrene liquid 26 is shown in Formula (I) below:

Formula (I)

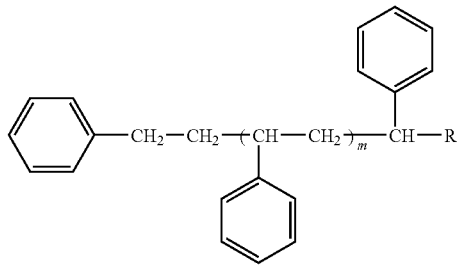

where R is selected from the group consisting of H, $CH_3$, $CH_2CH_3$, and $CH_2OCOOCH_3$; while m is between 0 and 10.

Figure 2B:
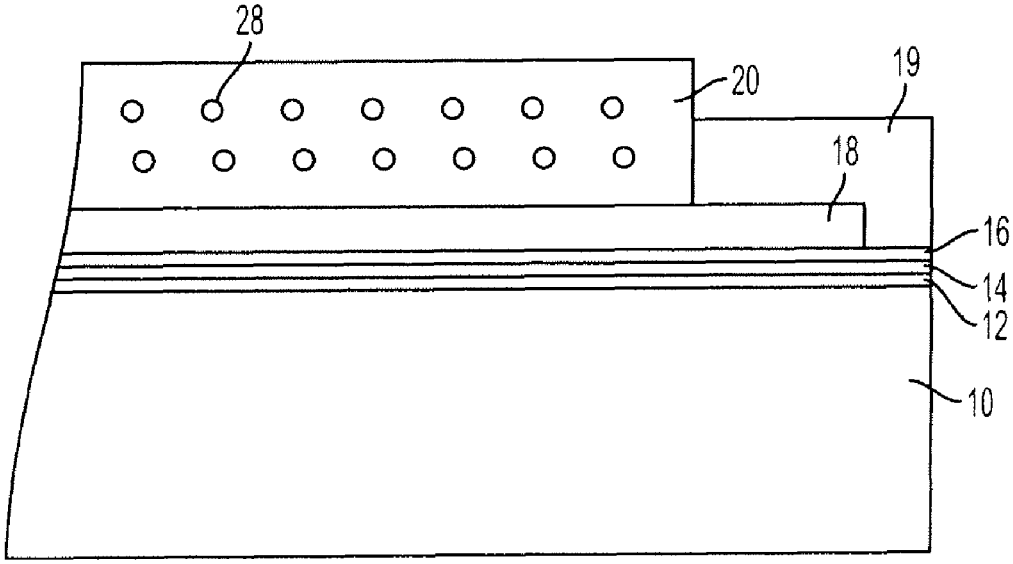
FIG. 2B is a cross-sectional view of another structurally simplified flexible multilayered electrophotographic imaging member having a single charge transport layer according to an embodiment of the present disclosure.

In the imaging member of these corresponding embodiments, the oligomeric polystyrene liquid in charge transport layer 20 of the disclosed imaging member in FIG. 2B is replaced with an alternate plasticizing liquid. That is the reformulated charge transport layer comprises a liquid monomer carbonate 28 incorporation into the same diamine m-TBD and bisphenol A polycarbonate charge transport layer material matrix. The content of the plasticizing liquid carbonate monomer is in a range of from about 3 to about 30 weight percent and preferably between about 10 and about 20 weight percent with respect to the summation weight the diamine m-TBD and the polycarbonate. The plasticizing liquid monomer carbonate 28 is a monomer bisphenol A carbonate and has the following molecular Formula (II):

Formula (II)

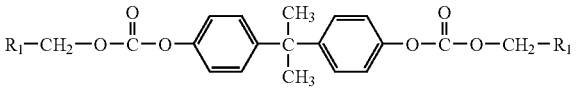

Where $R_1$ is H, $CH_3$, $CH_2CH_3$, and $CH_2OCOOCH_3$

Other aromatic carbonate liquids that are viable candidates for charge transport layer plasticizing may also be derived from Formula (II) and included for the present disclosure application. Their molecular structures are represented by Formulas (III) to (V) below:

Formula (III)

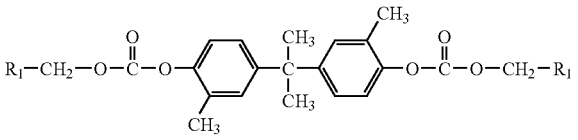

Formula (IV)

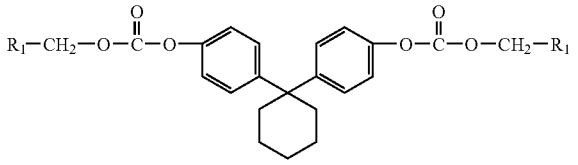

Formula (V)

Figure 3:
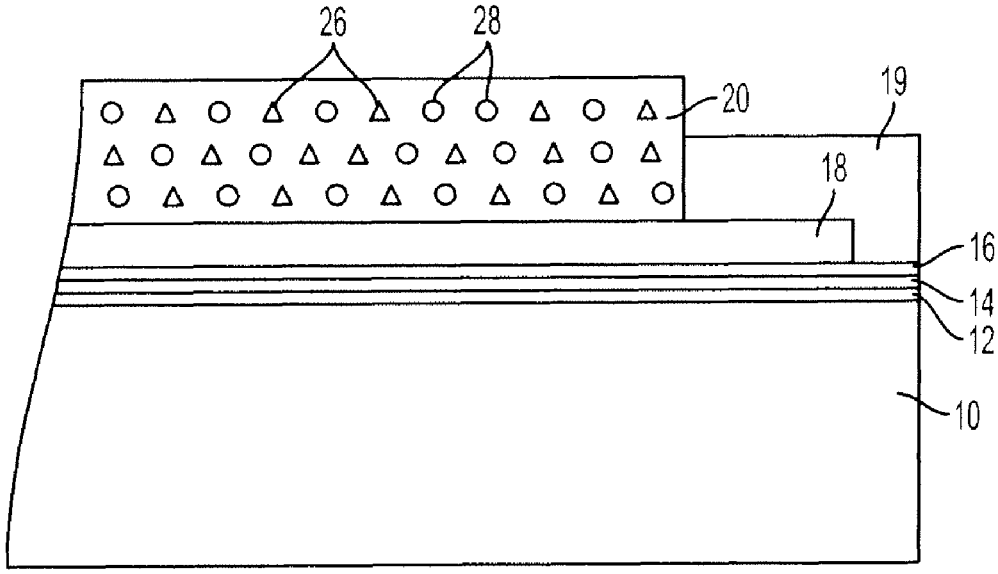
FIG. 3 is a cross-sectional view of yet another structurally simplified flexible multilayered electrophotographic imaging member having a single charge transport layer according to an embodiment of the present disclosure.

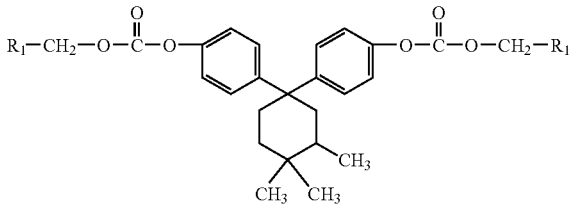

where $R_1$ in all these formulas is selected from the group consisting of H, $CH_3$, $CH_2CH_3$, and $CH_2OCOOCH_3$ Referring to FIG. 3, further embodiments of this disclosure have produce a plasticized charge transport layer 20 which is alternatively reformulated to comprise the very exact same diamine m-TBD and bisphenol A polycarbonate composition matrix according to the embodiments of FIGS. 2A & 2B, except that the plasticizer is a mixture of liquid oligomeric polystyrene 26 and monomer carbonate 28. The content of the two plasticizing liquids in the plasticized charge transport layer is in a range of from about 3 to about 30 weight percent and preferably between about 10 and about 20 weight percent with respect to the summation weight the diamine m-TBD and the polycarbonate. Therefore, the respective plasticizer ratio of oligomeric polystyrene to carbonate monomer (oligomeric polystyrene:monomer carbonate) that is present in the plasticized charge transport layer 20 is between about 10:90 and about 90:10.

Figure 4:
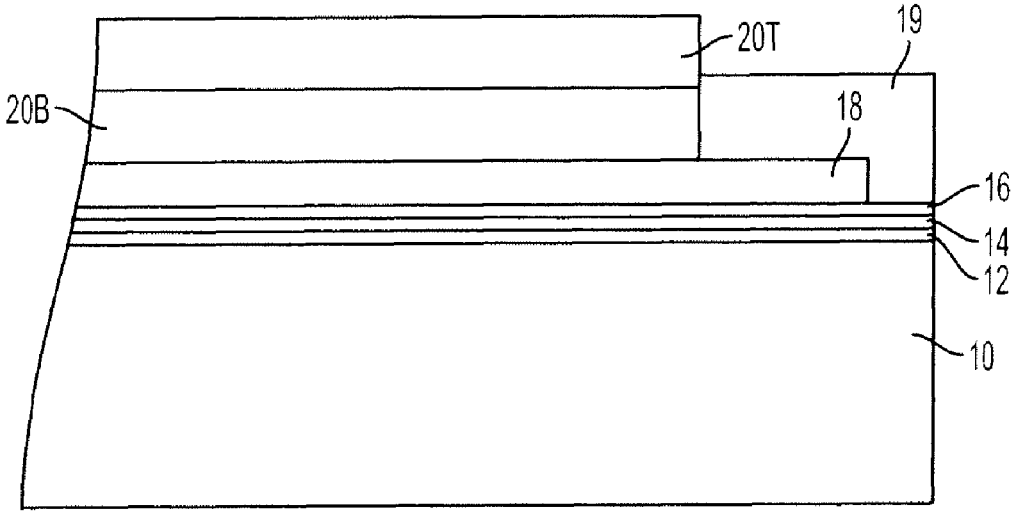
FIG. 4 is a cross-sectional view of a structurally simplified flexible multilayered electrophotographic imaging member having dual charge transport layers according to an embodiment of the present disclosure.

According to the extended embodiments, shown in FIG. 4, the charge transport layer 20 of FIG. 3 is redesigned to comprise oligomeric polystyrene liquid 26 plasticized dual layers: a bottom (first) layer 20B and a top (second) layer 20T using. Both of these layers comprise about the same thickness, same diamine m-TBD a polystyrene liquid addition of from about 3 to about 30 weight percent and preferably between about 10 and about 20 weight percent with respect to the summation weight the diamine m-TBD and the polycarbonate in each respective layer. In the modification of these very same extended embodiments of, the oligomeric polystyrene liquid plasticized dual layers are again reformulated such that the first layer contains larger amount of diamine m-TBD than that in the second layer; that is the first layer is comprised of about 40 to about 70 weight percent diamine m-TBD while the second layer comprises about 20 to about 60 weight percent diamine m-TBD.

In yet another extended embodiments of FIG. 4, both the dual charge transport layers are plasticized using the liquid monomer carbonate 28. Both of these layers are designed to comprise of about same thickness, same diamine m-TBD and bisphenol A polycarbonate composition matrix, and same amount of monomer carbonate liquid incorporation of from about 3 to about 30 weight percent and preferably between about 10 and about 20 weight percent with respect to the summation weight the diamine m-TBD and the polycarbonate in each respective layer. In the modification of these very same yet another extended embodiments, the monomer carbonate plasticized dual layers are then reformulated such that the first layer contains larger amount of diamine m-TBD than that in the second layer; that is the first layer is comprised of about 40 to about 70 weight percent diamine m-TBD while the second layer comprises about 20 to about 60 weight percent diamine m-TBD.

In still yet another extended embodiments of FIG. 4, both the dual charge transport layers are plasticized by the use of a mixing of liquid oligomeric polystyrene and monomer carbonate having respective plasticizer ratio of oligomeric polystyrene to carbonate monomer (oligomeric polystyrene: monomer carbonate) that is present in the plasticized dual layers is between about 10:90 and about 90:10. However, it is preferred that the mixture is of equal parts of liquid oligomeric styrene and carbonate monomer. Both of these layers are designed to comprise of about same thickness, same diamine m-TBD and bisphenol A polycarbonate composition matrix, and same amount of plasticizer liquid mixture incorporation of from about 3 to about 30 weight percent and preferably between about 10 and about 20 weight percent with respect to the summation weight the diamine m-TBD and the polycarbonate in each respective layer. In the modification of these very same yet another extended embodiments of FIG. 4, these plasticized dual layers are further reformulated such that the first layer contains larger amount of diamine m-TBD than that in the second layer; that is the first layer is comprised of about 40 to about 70 weight percent diamine m-TBD while the second layer comprises about 20 to about 60 weight percent diamine m-TBD.

Figure 5:
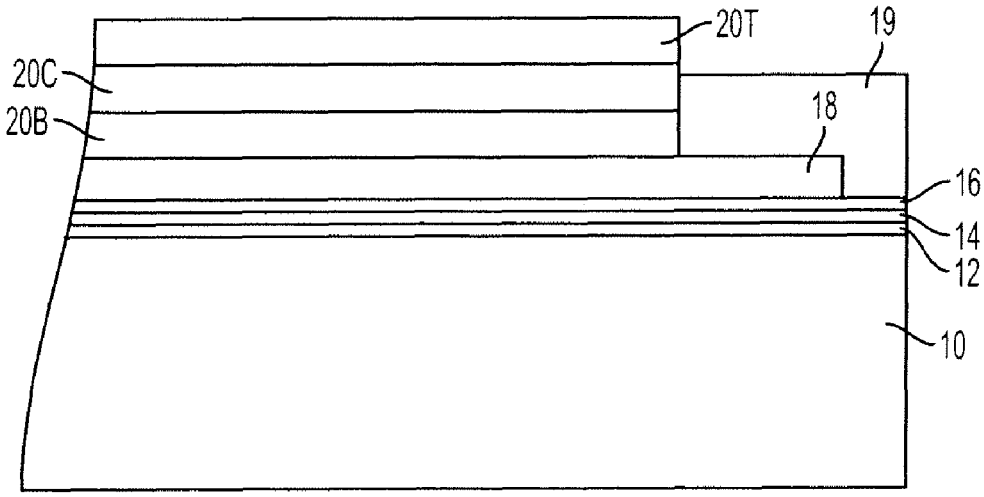
FIG. 5 is a cross-sectional view of a structurally simplified flexible multilayered electrophotographic imaging member having triple charge transport layers according to an embodiment of the present disclosure.

The plasticized charge transport layer in imaging members of additional embodiments, shown in FIG. 5, is redesigned to give triple layers: a bottom (first) layer 20B, a center (median) layer 20C, and a top (outer) layer 20T; all of which are plasticized with oligomeric polystyrene liquid. In these embodiments, all the triple layers comprise about same thickness, same diamine m-TBD and bisphenol A polycarbonate composition matrix, and same amount of oligomeric polystyrene liquid addition of from about 3 to about 30 weight percent and preferably between about 10 and about 20 weight percent with respect to the summation weight the diamine m-TBD and the polycarbonate in each respective layer. In the modification of these very same additional embodiments, the oligomeric polystyrene liquid plasticized triple layers are further reformulated to comprise different amount of diamine m-TBD content, in descending order from bottom to the top layer, such that the first layer has about 50 to about 80 weight percent, the second layer has about 40 and about 70 weight percent, and the third layer has about 20 and about 60 weight percent diamine m-TBD.

In the extension of the additional embodiments of FIG. 5, all the triple charge transport layers of the imaging member are plasticized with liquid monomer carbonate. In the embodiments, all of these layers comprise about same thickness, same diamine m-TBD and bisphenol A polycarbonate composition matrix, and same amount of carbonate monomer addition of from about 3 to about 30 weight percent and preferably between about 10 and about 20 weight percent with respect to the summation weight the diamine m-TBD and the polycarbonate in each respective layer. In the modification of these very same extension of additional embodiments, the carbonate monomer plasticized triple layers are further reformulated to comprise different amount of diamine m-TBD content, in descending concentration gradient from bottom to the top layer, such that the first layer has about 50 to about 80 weight percent, the second layer has about 40 and about 70 weight percent, and the third layer has about 20 and about 60 weight percent diamine m-TBD.

In the another extension of the additional embodiments of FIG. 5, all the triple charge transport layers of the imaging member are plasticized with a mixing of liquid oligomeric polystyrene and monomer carbonate having respective plasticizer ratio of oligomeric polystyrene to carbonate monomer (oligomeric polystyrene:monomer carbonate) that is present in the plasticized triple layers is between about 10:90 and about 90:10. However, it is preferred that the mixture is of equal parts of liquid oligomeric styrene and carbonate monomer. In these embodiments, all of these layers comprise about same thickness, same diamine m-TBD and bisphenol A polycarbonate composition matrix, and same amount of the two plasticizer addition of from about 3 to about 30 weight percent and preferably between about 10 and about 20 weight percent with respect to the summation weight the diamine m-TBD and the polycarbonate in each respective layer. In the modification of these very same another extension of additional embodiments, the plasticized triple layers are further reformulated to comprise different amount of diamine m-TBD content, in descending concentration gradient from bottom to the top layer, such that the first layer has about 50 to about 80 weight percent, the second layer has about 40 and about 70 weight percent, and the third layer has about 20 and about 60 weight percent diamine m-TBD.

Figure 6:
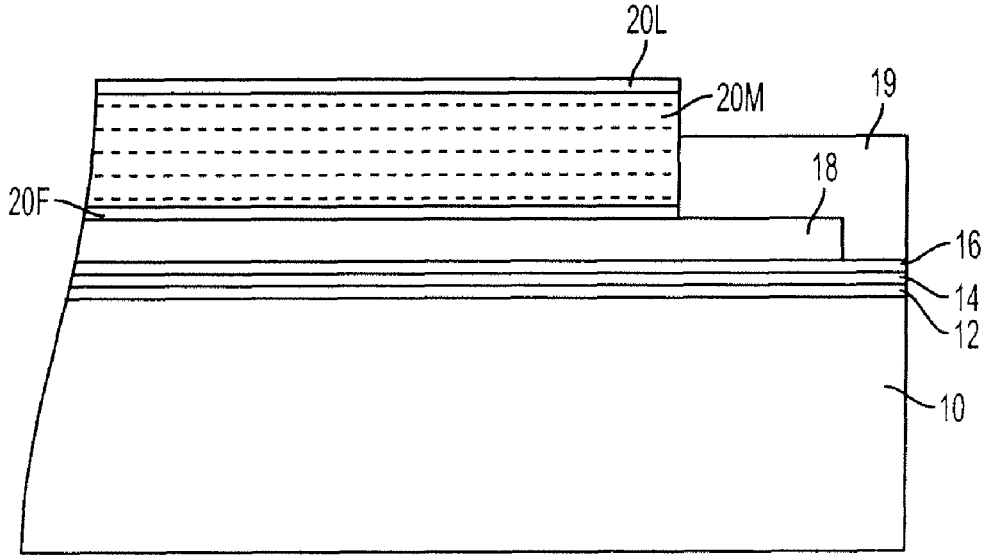
FIG. 6 is a cross-sectional view of a structurally simplified flexible multilayered electrophotographic imaging member having multiple charge transport layers according to an embodiment of the present disclosure.

In the innovative embodiments, the disclosed imaging member shown in FIG. 6 has plasticized multiple charge transport layers of having from about 4 to about 10 discreet layers, and preferably of between about 4 and about 6 discreet layers. These multiple layers are formed to have the same thickness, and consist of a first (bottom) layer 20F, multiple (intermediate) layers 20M, and a last (outermost) layer 20L. All these layers comprise a bisphenol A polycarbonate binder, same amount of oligomeric polystyrene liquid incorporation, and diamine m-TBD content present in descending continuum order from bottom to the top layer such that the bottom layer has about 50 to about 80 weight percent, the top layer has about 20 and about 60 weight percent. The amount of oligomeric styrene plasticizer incorporation into these multiple layers is from about 3 to about 30 weight percent and preferably between about 10 and about 20 weight percent with respect to the summation weight the diamine m-TBD and the polycarbonate in each respective layer. In the modification of these very exact same innovative embodiments, the plasticized multiple charge transport layers are then modified and reformulated to comprise monomer carbonate replacement by liquid oligmeric polystyrene plasticizer from each layer.

In the another innovative embodiments, the disclosed imaging member shown in FIG. 6 has a mixing of liquid oligomeric polystyrene and monomer carbonate having respective plasticizer ratio of oligomeric polystyrene to carbonate monomer (oligomeric polystyrene:monomer carbonate) that is present in the plasticized multiple charge transport layers is between about 10:90 and about 90:10. However, it is preferred that the mixture is of equal parts of liquid oligomeric styrene and carbonate monomer in these plasticized multiple layers of from about 4 to 10 about layers, and preferably of between about 4 and about 6 discreet layers. The multiple layers are formed to have the same thickness, and consist of a bottom layer, multi-intermediate layers, and a top layer. All these layers comprise a bisphenol A polycarbonate binder, same amount of oligomeric polystyrene and monomer carbonate liquid mixture incorporation, and diamine m-TBD content present in descending continuum order from bottom to the top layer such that the bottom layer has about 50 to about 80 weight percent, the top layer has about 20 and about 60 weight percent. The amount of plasticizer mixture incorporation into these multiple layers is from about 3 to about 30 weight percent and preferably between about 10 and about 20 weight percent with respect to the summation weight the diamine m-TBD and the polycarbonate in each respective layer.

Figure 7:
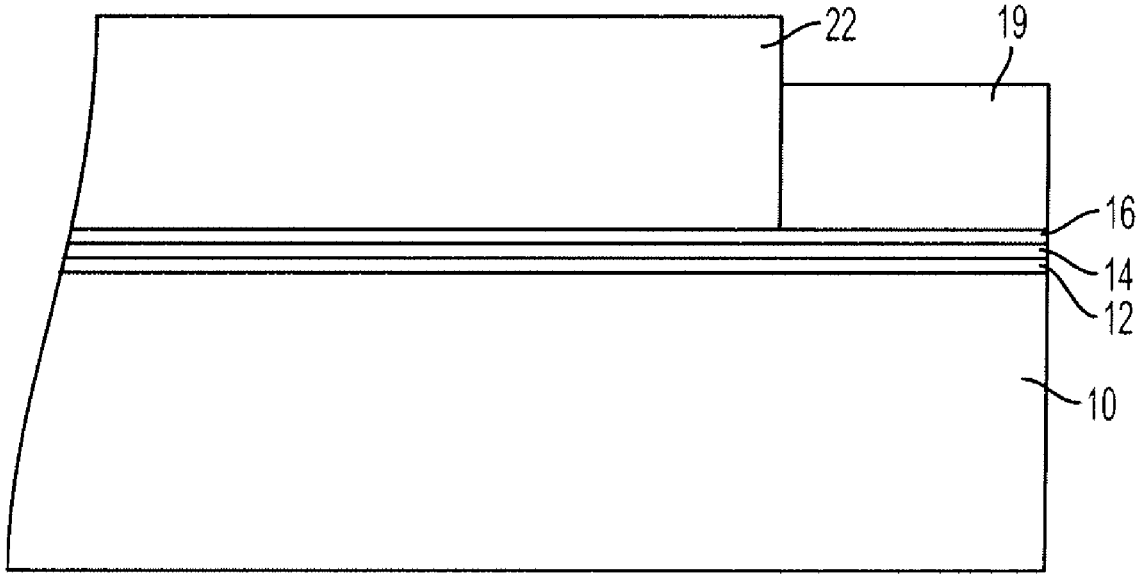
FIG. 7 is a cross-sectional view of a structurally simplified flexible multilayered electrophotographic imaging member having a single charge generating/transporting layer according to an alternative embodiment of the present disclosure.

As an alternative to the two discretely separated layers of being a charge transport 20 and a charge generation layers 18 as those described in FIG. 1, a structurally simplified imaging member, having all other layers being formed in the exact same manners as described in preceding figures, may be created to contain a single imaging layer 22 having both charge generating and charge transporting capabilities and also being plasticized with the use of the present disclosed plasticizers to eliminate the need of an anticurl back coating according to the illustration shown in FIG. 7. The single imaging layer 22 may comprise a single electrophotographically active layer capable of retaining an electrostatic charge in the dark during electrostatic charging, imagewise exposure and image development, as disclosed, for example, in U.S. Pat. No. 6,756,169. The single imaging layer 22 may be formed to include charge transport molecules in a binder, the same to those of the charge transport layer 20 previously described, and may also optionally include a photogenerating/photoconductive material similar to those of the layer 18 described above. In exemplary embodiments, the single imaging layer 22 of the imaging member of the present disclosure, shown in FIG. 7, is plasticized with oligomeric polystyrene liquid. The amount of oligomeric styrene plasticizer incorporation into the layer is from about 3 to about 30 weight percent and preferably between about 10 and about 20 weight percent with respect to the summation weight the diamine m-TBD and the polycarbonate in each respective layer. In another exemplary embodiments, the single imaging layer 22 of the disclosed imaging member is plasticized with monomer carbonate liquid. The amount of carbonate monomer plasticizer incorporation into the layer is from about 3 to about 30 weight percent and preferably between about 10 and about 20 weight percent with respect to the summation weight the diamine m-TBD and the polycarbonate in each respective layer.

In the extended exemplary embodiments, the single imaging layer 22 of the imaging member of the present disclosure is plasticized with a mixing of liquid oligomeric polystyrene and monomer carbonate having respective plasticizer ratio of oligomeric polystyrene to carbonate monomer (oligomeric polystyrene:monomer carbonate) that is present in the plasticized imaging layer 22 is between about 10:90 and about 90:10. However, it is preferred that the mixture is of equal parts of liquid oligomeric styrene and carbonate monomer. The amount of the mixture plasticizers incorporation into the layer is from about 3 to about 30 weight percent and preferably between about 10 and about 20 weight percent with respect to the summation weight the diamine m-TBD and the polycarbonate in each respective layer.

Generally, the thickness of the plasticized charge transport layer(s) and the plasticized single layer of all the imaging members, disclosed in FIGS. 2 to 7 above, is in the range of from about 10 to about 100 micrometers, but preferably between about 15 and about 50 micrometers. It is important to emphasize the reasons that the outermost top layer of imaging members employing compounded charge transport layers in the disclosure embodiments is formulated to comprise the least amount of diamine m-TBD charge transport molecules (in descending concentration gradient from the bottom layer to the top layer) are to: (1) inhibit diamine m-TBD crystallization at the interface between two coating layers and (2) also to enhance the top layer's fatigue cracking resistance during dynamic machine belt cyclic function in the field.

The flexible imaging members of present disclosure, prepared to contain a plasticized charge transport layer but no application of an anticurl backing layer, should have preserved the photoelectrical integrity with respect to each control imaging member. That means having charge acceptance ($V_0$) in a range of from about 750 to about 850 volts; sensitivity (S) sensitivity from about 250 to about 450 volts/ergs/$cm^2$; residual potential ($V_r$) less than about 150 volts; dark development potential (Vddp) of between about 280 and about 620 volts; and dark decay voltage (Vdd) of between about 70 and about 20 volts.

For typical conventional ionographic imaging members used in an electrographic system, an electrically insulating dielectric imaging layer is applied to the electrically conductive surface. The substrate also contains an anticurl back coating on the side opposite from the side bearing the electrically active layer to maintain imaging member flatness. In the present disclosure embodiments, ionographic imaging members may however be prepared without the need of an anticurl bad coating, through plasticizing the dielectric imaging layer with the use of liquid oligomeric styrene or liquid carbonate monomer incorporation according to the same manners and descriptions demonstrated in the curl-free electrophotographic imaging members preparation above.

To further improved the disclosed imaging member design's mechanical performance, the plasticized top imaging layer, may also include the additive of inorganic or organic fillers to impart greater wear resistant enhancement. Inorganic fillers may include, but are not limited to, silica, metal oxides, metal carbonate, metal silicates, and the like. Examples of organic fillers include, but are not limited to, KEVLAR, stearates, fluorocarbon (PTFE) polymers such as POLYMIST and ZONYL, waxy polyethylene such as ACUMIST and ACRAWAX, fatty amides such as PETRAC erucamide, oleamide, and stearamide, and the like. Either micron-sized or nano-sized inorganic or organic particles can be used in the fillers to achieve mechanical property reinforcement.

The flexible multilayered electrophotographic imaging member fabricated in accordance with the embodiments of present disclosure, described in all the above preceding, may be cut into rectangular sheets. A pair of opposite ends of each imaging member cut sheet is then brought overlapped together thereof and joined by any suitable means, such as ultrasonic welding, gluing, taping, stapling, or pressure and heat fusing to form a continuous imaging member seamed belt, sleeve, or cylinder.

A prepared flexible imaging belt thus may thereafter be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation, conventional positive or reversal development techniques may be employed to form a marking material image on the imaging surface of the electrophotographic imaging member. Thus, by applying a suitable electrical bias and selecting toner having the appropriate polarity of electrical charge, a toner image is formed in the charged areas or discharged areas on the imaging surface of the electrophotographic imaging member. For example, for positive development, charged toner particles are attracted to the oppositely charged electrostatic areas of the imaging surface and for reversal development, charged toner particles are attracted to the discharged areas of the imaging surface.

Furthermore, a prepared electrophotographic imaging member belt can additionally be evaluated by printing in a marking engine into which the belt, formed according to the exemplary embodiments, has been installed. For intrinsic electrical properties it can also be determined by conventional electrical drum scanners. Additionally, the assessment of its propensity of developing streak line defects print out in copies can alternatively be carried out by using electrical analyzing techniques, such as those disclosed in U.S. Pat. Nos. 5,703,487; 5,697,024; 6,008,653; 6,119,536; and 6,150,824, which are incorporated herein in their entireties by reference. All the patents and applications referred to herein are hereby specifically, and totally incorporated herein by reference in their entirety in the instant specification.

All the exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

EXAMPLES

The development of the presently disclosed embodiments will further be demonstrated in the non-limited Working Examples below. They are, therefore in all respects, to be considered as illustrative and not restrictive nor limited to the materials, conditions, process parameters, and the like recited herein. The scope of embodiments are being indicated by the appended claims rather than the foregoing description. All changes that come within the meaning of and range of equivalency of the claims are intended to be embraced therein. All proportions are by weight unless otherwise indicated. It will be apparent, however, that the present embodiments can be practiced with many types of compositions and can have many different uses in accordance with the disclosure above and as pointed out hereinafter.

Control. Example I

Single Charge Transport Layer Imaging Member Preparation

A conventional flexible electrophotographic imaging member web, as shown in FIG. 1, was prepared by providing a 0.02 micrometer thick titanium layer coated on a substrate of a biaxially oriented polyethylene naphthalate substrate (KADALEX, available from DuPont Teijin Films) having a thickness of 3.5 mils (89 micrometers). The titanized KADALEX substrate was extrusion coated with a blocking layer solution containing a mixture of 6.5 grams of gamma aminopropyltriethoxy silane, 39.4 grams of distilled water, 2.08 grams of acetic acid, 752.2 grams of 200 proof denatured alcohol and 200 grams of heptane. This wet coating layer was then allowed to dry for 5 minutes at 135° C. in a forced air oven to remove the solvents from the coating and form a crosslinked silane blocking layer. The resulting blocking layer had an average dry thickness of 0.04 micrometers as measured with an ellipsometer.

An adhesive interface layer was then extrusion coated by applying to the blocking layer a wet coating containing 5 percent by weight based on the total weight of the solution of polyester adhesive (MOR-ESTER 49,000, available from Morton International, Inc.) in a 70:30 (v/v) mixture of tetrahydrofuran/cyclohexanone. The resulting adhesive interface layer, after passing through an oven, had a dry thickness of 0.095 micrometers.

The adhesive interface layer was thereafter coated over with a charge generating layer. The charge generating layer dispersion was prepared by adding 1.5 gram of polystyrene-co-4-vinyl pyridine and 44.33 gm of toluene into a 4 ounce glass bottle. 1.5 grams of hydroxygallium phthalocyanine Type V and 300 grams of ⅛-inch (3.2 millimeters) diameter stainless steel shot were added to the solution. This mixture was then placed on a ball mill for about 8 to about 20 hours. The resulting slurry was thereafter coated onto the adhesive interface by extrusion application process to form a layer having a wet thickness of 0.25 mils. However, a strip of about 10 millimeters wide along one edge of the substrate web stock bearing the blocking layer and the adhesive layer was deliberately left uncoated by the charge generating layer to facilitate adequate electrical contact by a ground strip layer to be applied later. The wet charge generating layer was dried at 125° C. for 2 minutes in a forced air oven to form a dry charge generating layer having a thickness of 0.4 micrometers.

This coated web stock was simultaneously coated over with a charge transport layer and a ground strip layer by co-extrusion of the two coating solutions. The charge transport layer was prepared by combining MAKROLON 5705, a Bisphenol A polycarbonate thermoplastic having a molecular weight of about 120,000, commercially available from Farbensabricken Bayer A.G., with a charge transport compound N,N'-diphenyl-N,N'-bis(3-methylphenyl)-[1,1 '-biphenyl]-4,4'-diamine in an amber glass bottle in a weight ratio of 1:1 (or 50 weight percent of each). The resulting mixture was dissolved to give 15 percent by weight solid in methylene chloride and was applied onto the charge generating layer along with a ground strip layer during the co-extrusion coating process.

The strip, about 10 millimeters wide, of the adhesive layer left uncoated by the charge generating layer, was coated with a ground strip layer during the co-extrusion of charge transport layer and ground strip coating. The ground strip layer coating mixture was prepared by combining 23.81 grams of polycarbonate resin (MAKROLON 5705, 7.87 percent by total weight solids, available from Bayer A.G.), and 332 grams of methylene chloride in a carboy container. The container was covered tightly and placed on a roll mill for about 24 hours until the polycarbonate was dissolved in the methylene chloride. The resulting solution was mixed for 15-30 minutes with about 93.89 grams of graphite dispersion (12.3 percent by weight solids) of 9.41 parts by weight of graphite, 2.87 parts by weight of ethyl cellulose and 87.7 parts by weight of solvent (Acheson Graphite dispersion RW22790, available from Acheson Colloids Company) with the aid of a high shear blade dispersed in a water cooled, jacketed container to prevent the dispersion from overheating and losing solvent. The resulting dispersion was then filtered and the viscosity was adjusted with the aid of methylene chloride. This ground strip layer coating mixture was then applied, by co-extrusion coating along with the charge transport layer, to the electrophotographic imaging member web to form an electrically conductive ground strip layer.

The imaging member web stock containing all of the above layers was then transported at 60 feet per minute web speed and passed through 125° C. production coater forced air oven to dry the co-extrusion coated ground strip and charge transport layer simultaneously to give respective 19 micrometers and 29 micrometers in dried thicknesses. At this point, the imaging member, having all the dried coating layers, would spontaneously curl upwardly into a 1.5-inch tube when unrestrained as the web was cooled down to room ambient of 25° C. Since the charge transport layer, having a glass transition temperature (Tg) of 85° C. and a coefficient of thermal contraction of about $6.6\times10^{-5}$/° C., it had about 3.7 times greater dimensional contraction than that of the PEN substrate having lesser a thermal contraction of about $1.9\times10^{-5}$/° C. Therefore, according to equation (1), a 2.75% internal strain was built-up in the charge transport layer to result in imaging member upward curling.

An anti-curl coating was prepared by combining 88.2 grams of polycarbonate resin (MAKROLON 5705), 7.12 grams VITEL PE-2200 copolyester (available from Bostik, Inc. Middleton, Mass.) and 1,071 grams of methylene chloride in a carboy container to form a coating solution containing 8.9 percent solids. The container was covered tightly and placed on a roll mill for about 24 hours until the polycarbonate and polyester were dissolved in the methylene chloride to form the anti-curl back coating solution. The anti-curl back coating solution was then applied to the rear surface (side opposite the charge generating layer and charge transport layer) of the electrophotographic imaging member web by extrusion coating and dried to a maximum temperature of 125° C. in the forced air oven to produce a dried anti-curl backing layer having a thickness of 17 micrometers and flatten the imaging member. The resulting imaging member, according to conventional art shown in FIG. 1, has a 29 micrometer-thick single layered charge transport layer.

Disclosure Example I

Plasticized Single Charge Transport Layer Imaging Member Preparation

Five flexible electrophotographic imaging member webs, as shown in FIG. 2A, were prepared with the exact same material composition and following identical procedures as those described in the Control Example I, but with the exception that the anticurl back coating was excluded and the single charge transport layer of these imaging member webs was each respectively plasticized through the incorporation of 4, 8, 12, 16, and 20 weight percent of liquid styrene dimer of Formula (I) where $R_1$ is $CH_3$ (available form $SP^2$ Scientific Polymer Products, Inc.), based on the combined weight of Makrolon and the charge transport compound of the charge transport layer.

Disclosure Example II

Plasticized Single Charge Transport Layer Imaging Member Preparation

Five anticurl back coating free flexible electrophotographic imaging member webs like that of FIG. 2B were also prepared with the exact same material composition and following identical procedures as those described in Disclosure Example I, but with the exception that the single charge transport layer of these imaging member webs was each respectively incorporated with 4, 8, 12, 16, and 20 weight percent of an alternate plasticizing liquid monomer bisphenol A carbonate of Formula (II) where R1 is CH3 (available as CR-37 from PPG Industries, Inc.), based on the combined weight of Makrolon and the charge transport compound.

Control Example II

Dual Charge Transport Layers Imaging Member Preparation

A typical dual layered flexible electrophotographic imaging member web was prepared by using the exact same materials, composition, and following identical procedures as those describe in the Control Example I, except that the single charge transport layer was prepared to have dual layers: a bottom layer and a top layer with each having 14.5 micrometers in thickness; and the bottom layer contains 50:50 weight ratio of diamine charge transport compound to polycarbonate binder while the weight ratio of which in the top layer was 30:50.

Disclosure Example III

Plasticized Dual Charge Transport Layers Imaging Member Preparation

A flexible electrophotographic imaging member web was prepared with the exact same material composition and following identical procedures as those described in Control Example II, but with the exception that the anticurl back coating was excluded and the dual charge transport layers of this imaging member, as shown in FIG. 4, was each incorporated with 8 weight percent of liquid styrene dimer of Formula (I) where R is H, based on the combined weight of Makrolon and the charge transport compound in the charge transport layer.

Disclosure Example IV

Plasticized Dual Charge Transport Layers Imaging Member Preparation

An anticurl back coating free electrophotographic imaging member web was prepared with the exact same material composition and following identical procedures as those described in Disclosure Example III, but with the exception that the dual charge transport layers of this imaging member was each incorporated with 12 weight percent of alternate plasticizing liquid monomer bisphenol A carbonate of Formula (II) where $R_1$ is $CH_3$, based on the combined weight of Makrolon and the charge transport compound.

Curl, Tg, Photoelectrical, and Belt Print Testing Assessments

The prepared imaging members having plasticized charge transport layer (CTL) by incorporation of either the styrene dimer or bisphenol A carbonate into its material matrix of the Disclosure Examples were subsequently evaluated their respective degree of upward imaging member curling, CTL glass trnasistion temperature (Tg), photoelectrical properties integrity, and imaging member belt print testing against their respective imaging members of Control Examples.

Curl and Tg Determination:

The plasticized single CTL imaging members were then assessed for curl-up exhibition, measured for each respective diameter of curvature, and compared against that seen for the imaging member of Control Example I prior to its application of anticurl back coating. All these imaging members were also determined for their CTL glass transition temperature (Tg), using Differential Scanning Calorimetry (DSC) method. The results thus obtained for imaging members having CTL plasticized with styrene dimer and monomer carbonate and the control counterpart are separately tabulated in Tables 1 and 2 below:

TABLE 1

Styrene Dimer Plasticized CTL

| IDENTIFICATION | DIAMETER OF CURVATURE (in) | Tg (° C.) |
|---|---|---|
| Control Example I | 1.5 | 87 |
| 4% Styrene Dimer | 5.0 | 77 |
| 8% Styrene Dimer | 14.0 | 71 |
| 12% Styrene Dimer | 30 | 66 |
| 16% Styrene Dimer | flat | 60 |
| 20% Styrene Dimer | Flat | 50 |

TABLE 2

Monomer Carbonate Plasticized CTL

| IDENTIFICATION | DIAMETER OF CURVATURE (in) | Tg (° C.) |
|---|---|---|
| Control Example I | 1.5 | 87 |
| 4% Carbonate | 4.5 | 80 |
| 8% Carbonate | 12.5 | 76 |
| 12% Carbonate | 25 | 71 |
| 16% Carbonate | flat | 69 |
| 20% Carbonate | Flat | 57 |

The data given in the above tables show that the single layered CTL plasticized with either styrene dimer or monomer carbonate was sufficiently adequate to provide monotonous imaging member curl-up control with respective to the loading level of the plasticizer. Even though styrene dimer was seen to be slightly more effective to impact curl suppression than the monomer carbonate, nonetheless at a 12 weight percent incorporation to the CTL, both plasticizers were capable to produce approximately equivalent curl control result to give nearly flat imaging members. And at 16 weight percent incorporation, the plasticized CTL (using either plasticizer) was able to provide complete curl control and render the resulting imaging member with absolute flatness. Although plasticizing the CTL was effective to render the resulting imaging member with absolute flatness at loading level more than 12 weight percent, but styrene dimer or monomer carbonate presence in the CTL did cause CTL Tg depression. However, since the typically operation temperature of all xerographic imaging machines is less than 40° C., so the CTL Tg depression to 50° C., by plasticizer incorporation even at the highest 20 weight percent loading level, is still way above the imaging member belt machine functioning temperature in the field.

Photoelectrical Measurement and Belt Print Testing:

The prepared single layered CTL imaging members of Disclosure Examples I and II, comprising each respective plasticizing CTL, were then analyzed for the photo-electrical properties such as for the charge acceptance ($V_0$), sensitivity (S), residual potential ($V_r$), and dark decay potential (Vdd) to assess proper function against each respective control imaging member counterparts of Control Example I using the lab. 5000 scanner test. The results thus obtained, shown in below Table 2, had demonstrated that incorporation of the plasticizer liquid of either styrene dimer or carbonate monomer, at levels of 4, 8, 12, 16, and 20 weight percent, into the CTL had not been found to substantially impact the crucially important photoelectrical properties of the resulting imaging members as compared to those of each respective control imaging member counterpart. These results had therefore assured proper imaging member belt machine functional integrity in the field.

TABLE 2

| IDENTIFICATION | $V_0$ (volts) | S (volt/Erg/cm$^2$) | Vr (volts) | Vdd (volts) |
|---|---|---|---|---|
| Control Example I | 798 | 320 | 78 | 40 |
| 4% Styrene Dimer | 799 | 327 | 80 | 41 |
| 8% Styrene Dimer | 798 | 330 | 76 | 38 |
| 12% Styrene Dimer | 799 | 331 | 59 | 41 |
| 16% Styrene Dimer | 799 | 321 | 41 | 40 |
| 20% Styrene Dimer | 798 | 319 | 37 | 39 |
| Control Example (I)* | 799 | 336 | 39 | 37 |
| 4% Carbonate | 799 | 311 | 29 | 33 |
| 8% Carbonate | 799 | 288 | 25 | 31 |
| 12% Carbonate | 799 | 308 | 26 | 33 |
| 16% Carbonate | 798 | 291 | 18 | 29 |
| 20% Carbonate | 799 | 319 | 20 | 28 |

Note:
Control Example (1)* was another imaging member, prepared along with the disclosed imaging members utilizing carbonate monomer plasticizer, to serve as a control.

Further curl, Tg, and photoelectrical testing/evaluations carried out for imaging members having dual-layered CTL of present Disclosure Examples III and IV along with their respective control imaging member of Control Example II had also confirmed that plasticized the dual-layered CTL, in all the above experimental loading levels, had given results equivalent to those found for imaging members prepared to contain a single layered CTL.

Two single layered CTL imaging member webs, one having 8 weigh percent styrene dimer and the other having 12 weight percent carbonate plasticized CTL prepared according to Disclosure Examples I and II, and along with the imaging member web of Control Example I (as well as Control Example (I)*) were each cut to give three separate rectangular imaging member sheets of specified dimensions. The opposite ends of each cut sheet were looped and overlapped and then ultrasonically welded into three individual imaging member belts. The welded belts were subsequently print tested in the same selected xerographic machine to assess and compare each respective copy printout quality, failure modes, and the ultimate service life. The results thus obtained after machine belt print test run show that both imaging members of present disclosure, having a plasticized CTL and no anticurl back coating, did not develop abrasion line streak print defects copies nor fatigue induce CTL cracking after extended one million print out run. By comparison, the control imaging member belt was seen to show abrasion line streak print defects at 300,000 copies and had CTL cracking by 800,000 print volume. These machine test run results represent a more than 3 times imaging member belt service life function improvement. Furthermore, both the plasticized imaging member belts had also been found to give enhanced copy print out quality improvement.

Disclosure Concept Extension

Materials and preparation methodology of imaging member free of an anticurl back coating through CTL plasticization were further extended and demonstrated, according to the following additional working Examples, by utilizing mixtures of styrene dimer and monomer carbonate for CTL incorporation.

Disclosure Example A

Plasticized Single Charge Transport Layer Imaging Member Preparation

An anticurl free flexible electrophotographic imaging member web of was prepared with the exact same material composition and following identical procedures as those described in the Disclosure Example I, except that the single charge transport layer of the imaging member web was plasticized through the incorporation of 12 weight percent of a mixture of equal parts of liquid styrene dimer and liquid bisphenol A monomer carbonate, based on the combined weight of Makrolon and the charge transport compound of the charge transport layer.

Disclosure Example B

Plasticized Dual Charge Transport Layers Imaging Member Preparation

An anticurl back coating free flexible electrophotographic imaging member web was prepared with the exact same material composition and following identical procedures as those described in Disclosure Example IV, but with the exception that the dual charge transport layers of this imaging member was each incorporated with 12 weight percent of a mixture of equal parts of plasticizing liquid styrene dimer and liquid monomer bisphenol A carbonate, based on the combined weight of Makrolon and the charge transport compound of the charge transport layer Curl, Tg, Photoelectrical, and Belt Print Testing Assessments The prepared plasticized charge transport layer(s) imaging members of Disclosure Examples A and B, having a plasticized single layer CTL and plasticized dual CTL by respectively using a mixture of equal parts of plasticizing liquid styrene dimer and liquid monomer bisphenol A carbonate, along with the imaging members of Control Examples I and II were evaluated according to the following testing methods:

(1) photoelectrical properties integrity;

(2) curl-up assessment;

(3) each CTL glass transition temperature (Tg); and (4) welded belts print tested run using the same selected xerographic machine to determine/compare each respective copy printout quality, failure modes, and the ultimate service life.

All these testing, evaluation, and assessment were conducted according to the exact same manners and procedures as those detailed in the preceding. The testing results thus collected for these imaging members having CTL plasticized with mixture of liquid styrene dimer and monomer bisphenol A carbonate were seen to be about equivalent to those obtained for the imaging members employed a single plasticizing liquid in CTL. Additionally, both plasticized single layer CTL and dual layered CTL by using a single plasticizer or mixing plasticizer in all loading levels disclosed in all the above Working Examples were all found to have good layer adhesion value greater than that of the adhesion specification; this would therefore ensure that the CTL layer's bonding strength and integrity without the possibility of delamination during imaging member belt dynamic fatigue machine function in the field.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. An imaging member comprising:

a substrate;

a charge generating layer disposed on the substrate;

a charge transport layer disposed on the charge generating layer, wherein the charge transport layer has multiple layers and each layer comprises a polycarbonate, a charge transport compound of N,N'-diphenyl-N,N'-bis(3-methylphenyl)-1,1-biphenyl-4,4'-diamine, and a liquid compound having a high boiling point, and further wherein the liquid compound is miscible with both the polycarbonate and N,N'-diphenyl-N,N'-bis(3-methylphenyl)-1,1-biphenyl-4,4'-diamine.

2. The imaging member of claim 1, wherein the liquid compound has a boiling point that exceeds 300° C. and the liquid compound is present in the charge transport layer in an amount of from about 3% to about 30% by weight of the total weight of the polycarbonate and N,N'-diphenyl-N,N'-bis(3-methylphenyl)-1,1-biphenyl-4,4'-diamine in the charge transport layer.

3. The imaging member of claim 2, wherein the liquid compound is present in an amount of from about 10% to about 20% by weight of the polycarbonate and N,N'-diphenyl-N,N'-bis(3-methylphenyl)-1,1-biphenyl-4,4'-diamine in the charge transport layer.

4. The imaging member of claim 1, wherein the liquid compound is selected from the group consisting of an oligomeric polystyrene, carbonate monomer, and mixtures thereof.

5. The imaging member of claim 4, wherein the liquid compound comprises an oligomeric polystyrene that has a formula selected from the group consisting of:

Formula (I)

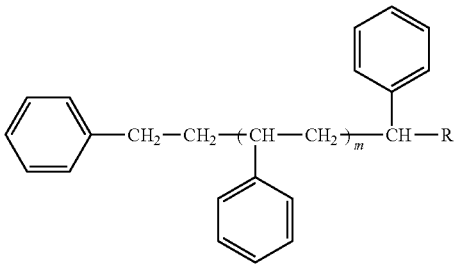

wherein R is selected from the group consisting of H, $CH_3$, $CH_2CH_3$, and $CH_2OCOOCH_3$; while m is between 0 and 10;

Formula (III)

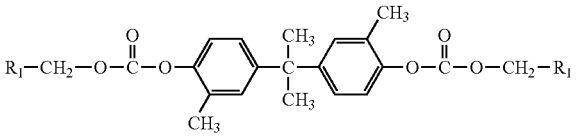

wherein $R_1$ is selected from the group consisting of H, $CH_3$, $CH_2CH_3$, and $CH_2OCOOCH_3$;

Formula (IV)

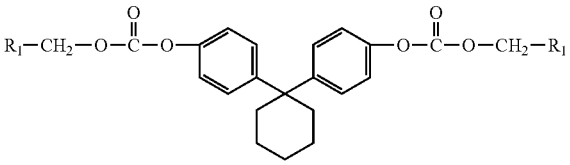

wherein $R_1$ is selected from the group consisting of H, $CH_3$, $CH_2CH_3$, and $CH_2OCOOCH_3$;

Formula (V)

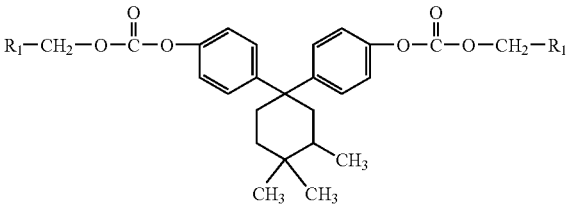

wherein $R_1$ is selected from the group consisting of H, $CH_3$, $CH_2CH_3$, and $CH_2OCOOCH_3$; and mixtures thereof.

6. The imaging member of claim 5, wherein the liquid oligomeric polystyrene is a dimer that has the following formula:

Formula (I)

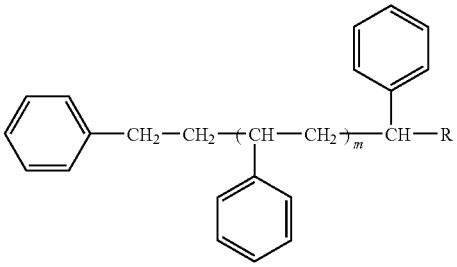

wherein R is selected from the group consisting H and $CH_3$.

7. The imaging member of claim 4, wherein the carbonate monomer has the following formula:

Formula (II)

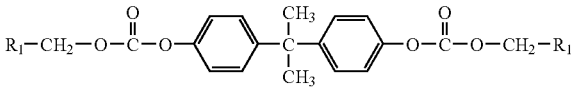

wherein $R_1$ is H, $CH_3$, $CH_2CH_3$, and $CH_2OCOOCH_3$.

8. The imaging member of claim 1, wherein the charge transport layer has dual layers and a first charge transport layer is disposed on the charge generating layer and a second charge transport layer is disposed on the first charge transport layer.

9. The imaging member of claim 1, wherein the charge transport layer has triple layers and a first charge transport layer is disposed on the charge generating layer, a second charge transport layer is disposed on the first charge transport layer, and a third charge transport layer is disposed on the second charge transport layer.

10. The imaging member of claim 1, wherein the multiple charge transport layers are of the same thickness.

11. The imaging member of claim 1, wherein the liquid compound in each of the multiple layers is different.

12. The imaging member of claim 1, wherein the liquid compound in each of the multiple layers is the same.

13. The imaging member of claim 1, wherein the liquid compound in each of the multiple layers comprises a mixture of different liquid compounds.

14. The imaging member of claim 1, wherein an amount of N,N'-diphenyl-N,N'-bis(3-methylphenyl)-1,1-biphenyl-4,4'-diamine present in each of the multiple layers decreases from the innermost charge transport layer to the outermost charge transport layer.

15. An imaging member comprising:

a substrate;

a charge generating layer disposed on the substrate;

a first charge transport layer disposed on the charge generating layer, wherein the charge transport layer comprises a polycarbonate, N,N'-diphenyl-N,N'-bis(3-methylphenyl)-1,1-biphenyl-4,4'-diamine, and a liquid compound having a high boiling point that exceeds 300° C., and further wherein the liquid compound is miscible with both the polycarbonate and N,N'-diphenyl-N,N'-bis(3-methylphenyl)-1,1-biphenyl-4,4'-diamine; and a second charge transport layer disposed on the first charge transport layer, wherein the second charge transport layer comprises a polycarbonate, N,N'-diphenyl-N,N'-bis(3-methylphenyl)-1,1-biphenyl-4,4'-diamine, and a liquid compound having a high boiling point that exceeds 300° C., and further wherein the liquid compound is miscible with both the polycarbonate and N,N'-diphenyl-N,N'-bis(3-methylphenyl)-1,1-biphenyl-4,4'-diamine.

16. The imaging member of claim 15, wherein the liquid compound is selected from the group consisting of an oligomeric polystyrene, carbonate monomer, and mixtures thereof.

17. The imaging member of claim 15, wherein the liquid compound in the first charge transport layer is different than the liquid compound in the second charge transport layer.

18. The imaging member of claim 15, wherein the liquid compound in the first charge transport layer is the same as the liquid compound in the second charge transport layer.

19. The imaging member of claim 15, wherein the liquid compound in the first charge transport layer and the liquid compound in the second charge transport layer both comprise mixtures of polystyrene dimer and carbonate monomer.

20. An imaging member comprising:

a substrate;

a charge generating layer disposed on the substrate;

a first charge transport layer disposed on the charge generating layer, wherein the charge transport layer comprises a polycarbonate, N,N'-diphenyl-N,N'-bis(3-methylphenyl)-1,1-biphenyl4,4'-diamine, and a liquid compound having a high boiling point that exceeds 300° C., and further wherein the liquid compound is miscible with both the polycarbonate and N,N'-diphenyl-N,N'-bis(3-methylphenyl)-1,1-biphenyl-4,4'-diamine;

a second charge transport layer disposed on the first charge transport layer, wherein the second charge transport layer comprises a polycarbonate, N,N'-diphenyl-N,N'-bis(3-methylphenyl)-1,1-biphenyl4,4'-diamine, and a liquid compound having a high boiling point that exceeds 300° C., and further wherein the liquid compound is miscible with both the polycarbonate and N,N'-diphenyl-N,N'-bis(3-methylphenyl)-1,1-biphenyl-4,4'-diamine; and a third charge transport layer disposed on the second charge transport layer, wherein the third charge transport layer comprises a polycarbonate, N,N'-diphenyl-N,N'-bis(3-methylphenyl)-1,1-biphenyl-4,4'-diamine, and a liquid compound having a high boiling point that exceeds 300° C., and further wherein the liquid compound is miscible with both the polycarbonate and N,N'-diphenyl-N,N'-bis(3-methylphenyl)-1,1-biphenyl-4,4'-diamine.

21. The imaging member of claim 20, wherein the liquid compound is selected from the group consisting of an oligomeric polystyrene, carbonate monomer, and mixtures thereof.

22. The imaging member of claim 20, wherein the liquid compound in the first charge transport layer, second transport layer and third transport layer are different liquid compounds.

23. The imaging member of claim 20, wherein the liquid compound in the first charge transport layer, second transport layer and third transport layer are the same liquid compounds.

24. The imaging member of claim 20, wherein the liquid compound in the first charge transport layer, second transport layer and third transport layer all comprise mixtures of polystyrene and carbonate monomer.

25. The imaging member of claim 20, wherein an amount of N,N'-diphenyl-N,N'-bis(3-methylphenyl)-1,1-biphenyl-4,4'-diamine present in each of the first charge transport layer, second charge transport layer and third charge transport layer such that the amount of N,N'-diphenyl-N,N'-bis(3-methylphenyl)-1,1-biphenyl-4,4'-diamine decreases from the first charge transport layer to the third charge transport layer.

* * * * *